US008752797B2

(12) United States Patent
Carlson et al.

(10) Patent No.: US 8,752,797 B2
(45) Date of Patent: Jun. 17, 2014

(54) RAIL LINE SENSING AND SAFETY SYSTEM

(75) Inventors: Richard C. Carlson, Wauconda, IL (US); Peter Strezev, Apollo Beach, FL (US); Kurt A. Gunther, Round Lake Heights, IL (US); Marc W. Cygnus, Mundelein, IL (US)

(73) Assignee: Metrom Rail, LLC, Lake Zurich, IL (US)

( * ) Notice: Subject to any disclaimer, the term of this patent is extended or adjusted under 35 U.S.C. 154(b) by 188 days.

(21) Appl. No.: 13/310,006

(22) Filed: Dec. 2, 2011

(65) Prior Publication Data

US 2012/0138752 A1 Jun. 7, 2012

Related U.S. Application Data

(60) Provisional application No. 61/458,805, filed on Dec. 3, 2010, provisional application No. 61/457,532, filed on Apr. 18, 2011, provisional application No. 61/519,202, filed on May 19, 2011, provisional application No. 61/627,270, filed on Oct. 11, 2011.

(51) Int. Cl.
*B61L 23/34* (2006.01)
*B61L 21/00* (2006.01)

(52) U.S. Cl.
USPC ..... 246/122 R; 246/28 R

(58) Field of Classification Search
USPC ..... 246/1 R, 1 C, 20, 21, 27, 28 R, 122–126, 246/218–221
See application file for complete search history.

(56) References Cited

U.S. PATENT DOCUMENTS

| | | | |
|---|---|---|---|
| 2,231,105 | A | 2/1941 | Block et al. |
| 2,617,023 | A | 11/1952 | Weller |
| 2,892,078 | A | 6/1959 | Orthuber |
| 2,973,430 | A | 2/1961 | Pelino |
| 3,086,109 | A | 4/1963 | Kaehms |
| 3,151,827 | A | 10/1964 | Gallagher |
| 3,195,043 | A | 7/1965 | Burig |
| 3,395,341 | A | 7/1968 | Malaquin |
| 3,697,745 | A | 10/1972 | Bolton |

(Continued)

OTHER PUBLICATIONS

Patent Cooperation Treaty, Notification of Transmittal of the International Search Report and the Written Opinion of the International Searching Authority, or the Declaration, in International application No. PCT/US11/63080, dated Mar. 2, 2012 (11 pages).

*Primary Examiner* — R. J. McCarry, Jr.
(74) *Attorney, Agent, or Firm* — McAndrews, Held & Malloy, Ltd.

(57) ABSTRACT

A rail line sensing and safety system adapted to reliably sense the presence, and optionally the direction and speed, of vehicles traveling on a rail line, and when a vehicle is sensed, to indicate whether a safety device, such as crossing gates, lights, bells, etc., should be activated. The system comprises at least one detection module typically mounted on a rail, at least one remote module typically located near a detection module, and at least one control module typically located near a safety device. In operation, a detection module senses a vehicle traveling on a rail line and sends signals to a remote module. The remote module then processes signals received from the detection module and transmits signals to the control module. The control module then directs, either directly or indirectly as a backup or supplement to an existing sensing and safety system, whether a safety device should be activated.

29 Claims, 12 Drawing Sheets

(56) References Cited

U.S. PATENT DOCUMENTS

| | | | |
|---|---|---|---|
| 3,721,821 | A | 3/1973 | Blanyer |
| 3,721,859 | A | 3/1973 | Blanyer |
| 3,941,338 | A | 3/1976 | Knudsen |
| 4,200,855 | A | 4/1980 | Gilcher |
| 4,200,856 | A | 4/1980 | Gilcher |
| 4,236,093 | A | 11/1980 | Birnbaum |
| 4,351,504 | A | 9/1982 | Frielinghaus |
| 4,365,777 | A | 12/1982 | Geiger |
| 4,379,330 | A | 4/1983 | Sanville |
| 4,524,932 | A | 6/1985 | Bodziak |
| 4,570,882 | A | 2/1986 | Frielinghaus |
| 4,932,784 | A | 6/1990 | Danneskiold-Samsoe |
| 5,129,606 | A | 7/1992 | Rodems et al. |
| 5,333,820 | A | 8/1994 | Gilcher |
| 5,395,078 | A | 3/1995 | Gellender |
| 5,628,479 | A | 5/1997 | Ballinger |
| 5,764,162 | A | 6/1998 | Ehrlich |
| 6,149,106 | A | 11/2000 | McQuistian |
| 6,663,053 | B1 | 12/2003 | Shams |
| 6,899,303 | B2 | 5/2005 | Shams |
| 7,216,558 | B2 | 5/2007 | Kumar et al. |
| 7,481,400 | B2 | 1/2009 | Appleby et al. |
| 2003/0058131 | A1 | 3/2003 | Grisham |
| 2006/0076461 | A1 | 4/2006 | DeRose et al. |
| 2008/0303518 | A1* | 12/2008 | Heyden et al. ..... 324/244 |
| 2009/0013543 | A1 | 1/2009 | Zhang |
| 2009/0326746 | A1 | 12/2009 | Mian |
| 2010/0212958 | A1 | 8/2010 | Siems |
| 2010/0258682 | A1 | 10/2010 | Fries |
| 2011/0133038 | A1 | 6/2011 | Kiss, Jr. et al. |

* cited by examiner

RAIL LINE SENSING AND SAFETY SYSTEM

CROSS-REFERENCE TO RELATED APPLICATION(S)

This application claims priority from the following four U.S. Provisional Patent Applications: (1) No. 61/458,805 filed on Dec. 3, 2010, (2) No. 61/457,532 filed on Apr. 18, 2011, (3) No. 61/519,202 filed on May 19, 2011, and (4) No. 61/627,270 filed on Oct. 11, 2011. The disclosures of these four applications are incorporated by reference herein in their entireties.

BACKGROUND

Rail lines, such as railroads for trains, create safety concerns where they intersect with roads, other rail lines or other paths of travel. These intersections (crossings) are notorious for collisions between vehicles. Various types of safety devices (for example, lights and crossing gates) are used to warn approaching vehicles of a potential collision. However, current systems for sensing an approaching train and activating a safety device are not sufficiently reliable under certain operating conditions.

BRIEF DESCRIPTION OF THE DRAWINGS

Several features and advantages are described in the following disclosure, in which several embodiments are explained, using the following drawings as examples.

BRIEF DESCRIPTION OF THE PREFERRED EMBODIMENTS

Figure 1:
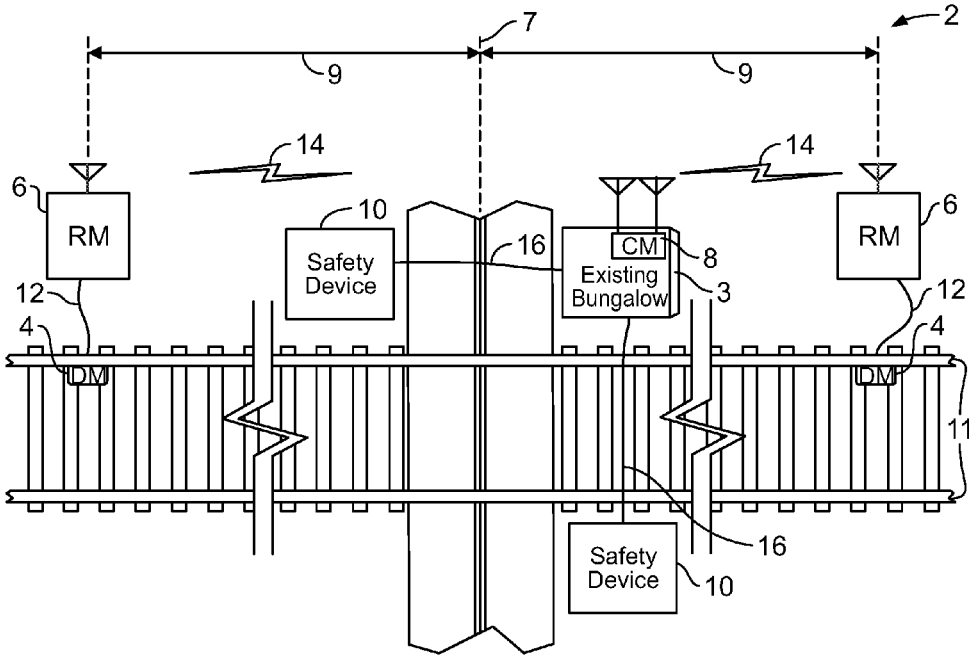
FIG. 1 shows a bird's eye schematic view of a rail line sensing and safety system.

The following disclosure describes a rail line sensing and safety system adapted to reliably sense the presence, as well as the direction and speed, of vehicles, including high-speed vehicles, traveling on a rail line. The rail line sensing and safety system then indicates whether a safety device, such as crossing gates, lights, bells, visual, audio or physical warnings, and combinations thereof, should be activated.

In one embodiment, the rail line sensing and safety system comprises at least one sensing device (also referred to as a detection module) for a rail line. The sensing device in turn comprises: (1) a first sensor capable of detecting a vehicle traveling on the rail line and signaling a first detection event; (2) a second sensor capable of detecting the vehicle traveling on the rail line and signaling a second detection event, wherein the second sensor is located a fixed distance away from the first sensor; (3) electrical circuitry that accepts signals from the two sensors; and (4) electrical connections that electrically connect the two sensors and the electrical circuitry.

In one example of the sensing device, the first sensor and the second sensor may be inductive sensors, each sensor comprising wire wound on a ferrite core, and wherein the wire is Litz Wire, and wherein each sensor is capable of generating a magnetic field that extends a distance above the sensor, and wherein the electrical circuitry is capable of detecting an interruption in the magnetic field of either the first sensor, the second sensor, or both. The ferrite core may be, for example, a PQ-style ferrite core.

In another example of the sensing device, the first sensor and the second sensor may comprise a coil of wire operable to inductively couple to at least one part of the vehicle traveling on the rail line, and wherein the electrical circuitry is configured to generate, for the first sensor, a first coupling signal and a first output pulse signal, the magnitude of the first coupling signal being based on the amount of inductive coupling between the coil of wire of the first sensor and the vehicle, the first output pulse signal being an output pulse triggered in response to the first coupling signal indicating that the amount of inductive coupling between the coil of wire of the first sensor and the vehicle is approximately at a maximum, and wherein the electrical circuitry is configured to generate, for the second sensor, a second coupling signal and a second output pulse signal, the magnitude of the second coupling signal being based on the amount of inductive coupling between the coil of wire of the second sensor and the vehicle, the second output pulse signal being an output pulse triggered in response to the second coupling signal indicating that the amount of inductive coupling between the coil of wire of the second sensor and the vehicle is approximately at a maximum.

In this example, as the vehicle gets closer to the sensor's coil of wire, the amount of inductive coupling between the coil of wire and the vehicle increases and the Q factor of the coil of wire decreases, and wherein the magnitude of the coupling signal increases when the amount of inductive coupling between the coil of wire and the vehicle increases.

In this example, the first output pulse signal generated by the circuitry for the first sensor corresponds to the signaling of the first detection event, and the second output pulse signal generated by the circuitry for the second sensor corresponds to the signaling of the second detection event.

In this example, the electrical circuitry may comprise, for each of the first sensor and the second sensor, a peak-and-hold detector that is operable to detect a peak in the magnitude of the coupling signal, and trigger the output pulse signal when the peak in the magnitude of the coupling signal is detected. The electrical circuitry may comprise, for each of the first sensor and the second sensor, a capacitor located between the wire carrying the coupling signal and the peak-and-hold detector, and wherein the capacitor removes a DC component of the coupling signal, allowing only an AC component of the coupling signal to pass through to the peak-and-hold detector, and wherein the capacitor ensures that static DC-signal drift in the coupling signal is not introduced to the peak-and-hold detector.

In this example, the electrical circuitry may comprise, for each of the first sensor and the second sensor, an amplifier operable to amplify the coupling signal, the amplifier comprising a feedback path having a Zener diode to produce a logarithmic transfer characteristic of the amplifier such that the amplifier is capable of accurately handling the coupling signal regardless of whether its magnitude is large or small. The electrical circuitry may also comprise, for each of the first sensor and the second sensor, a comparator operable to terminate the output pulse when the magnitude of the coupling signal falls from a peak magnitude to below a threshold value. The electrical circuitry may also be operable to detect an error or a fault in the electrical circuitry and to generate an error signal when the error or fault is detected.

In another example of the sensing device, the sensing device further comprises a sensor package that houses at least the two sensors, the electrical circuitry and the electrical connections, wherein the sensor package includes an upper casing and a lower casing such that when the two casings are affixed together, a cavity is defined between them, wherein the sensor package includes an attachment device for attaching the sensor package to the rail line.

In this example, the attachment device may be an energy absorbing mounting system comprised of: (1) a clamp assembly for attaching the sensor package to the rail line; (2) aluminum shims and vibration absorption pads disposed between the sensor package and the clamp assembly, wherein the vibration absorption pads are composed of rubber or an elastomeric material or other vibration absorbing material; (3) cap screws that run vertically through the sensor package, the aluminum shims, the vibration absorption pads, and into the clamp assembly, wherein the cap screws apply clamping force to attach the sensor package to the rest of the attachment device and to hold the parts of the attachment device together; and (4) lock pins that are inserted horizontally into the side of the sensor package to prevent the cap screws from rotating.

In another example of the sensing device, the electrical circuitry of the sensing device may include a signal processor. The signal processor may be programmed to calculate the direction, speed or both of the vehicle traveling on the rail line by detecting the order of the first detection event in relation to the second detection event, and measuring the time period between the detection events.

In another example of the sensing device, the sensing device may further comprise at least one additional sensor capable of detecting the vehicle traveling on the rail line and signaling at least one additional detection event, wherein the electrical circuitry also accepts signals from the at least one additional sensor, wherein the electrical connections also electrically connect the at least one additional sensor.

In one embodiment of the rail line sensing and safety system, the system comprises: (1) at least one sensing device for a rail line according to claim 1, wherein each sensing device outputs one or more signals that indicate at least one of the presence, direction and speed of a vehicle traveling on the rail line; (2) at least one remote module that accepts signals outputted by at least one of the sensing devices, wherein the remote module processes signals and transmits one or more signals, wherein the remote module is located near the sensing device from which it accepts signals; and (3) a control module that accepts signals outputted by at least one of the remote modules, wherein the control module performs operations based on signals and outputs one or more signals, wherein the signals outputted by the control module indicate, among other things, whether one or more safety devices should be activated, the safety devices being lights, gates, bells, visual, audio or physical warnings, and combinations thereof, wherein the control module and the safety devices are located near an intersection of a rail line and a road, a second rail line, or other path of travel.

In one example, the rail line sensing and safety system further comprises one or more solar panels electrically connected to one or more devices or modules, including the sensing device, the remote module and the control module; and one or more battery packs electrically connected to one or more devices or modules, including the sensing device, the remote module and the control module.

In another example of the rail line sensing and safety system, the signals outputted by the control module are sent directly to the one or more safety devices, and wherein the rail line sensing and safety system provides primary control signals for the safety devices. In this example, the rail line sensing and safety system may further comprise at least one backup sensing device, wherein at least one sensing device located on either side of the safety devices is backed up, as a form of redundancy, by the at least one backup sensing device, wherein the backup sensing device is located a distance away from the sensing device that it backs up, wherein the backup sensing device outputs signals that indicate at least one of the presence, direction and speed of a vehicle traveling on the rail line.

In another example of the rail line sensing and safety system, the system is adapted to be a supplemental or backup system to a separate existing system, wherein the signals outputted by the control module are sent to the existing system, and wherein the existing system controls one or more safety devices. The existing system may attempt to detect the vehicle traveling on the rail line by sending one or more electrical signals down one or more rails of the rail line, whereby the rail operates as a conductor for the one or more signals to travel through. In this example, the rail line sensing and safety system may further comprising at least one backup sensing device, wherein at least one sensing device located on either side of the safety devices is backed up, as a form of redundancy, by the at least one backup sensing device, wherein the backup sensing device is located a distance away from the sensing device that it backs up, wherein the backup sensing device outputs signals that indicate at least one of the presence, direction and speed of a vehicle traveling on the rail line.

In another example of the rail line sensing and safety system, the system may further comprise at least one sensor that monitors health of at least one device or module in the system, including the sensing device and the remote module, wherein the signals transmitted by the remote module and sent to the control module periodically include information regarding health of at least one device or module, wherein the control module is adapted to accept signals and information regarding health of devices or modules.

In another example of the rail line sensing and safety system, the control module may include computing equipment capable of data logging and self-diagnostics. Additionally, the system may further comprise a display that is part of the control module, wherein the display conveys system diagnostics and status indicators.

In another example of the rail line sensing and safety system, the remote module may transmit one or more signals using a frequency hopping radio. Alternatively, the remote module may transmit one or more signals using a cellular network. Alternatively, the remote module may transmit one or more signals using a licensed frequency.

In another example of the rail line sensing and safety system, the sensing device may be located a distance away from the one or more safety devices that the sensing and safety system controls, wherein the distance is between 3,800 feet and 4,500 feet.

DETAILED DESCRIPTION OF PREFERRED EMBODIMENTS

The rail industry could benefit from a system, according to this disclosure, that addresses concerns such as safety, reliability, efficiency, ease of control and cost. These concerns only increase with the introduction of high speed vehicles traveling on rail lines.

The following disclosure describes a rail line sensing and safety system (RLSSS) adapted to reliably sense the presence, as well as the direction and speed, of vehicles, including high-speed vehicles, traveling on a rail line. The rail line sensing and safety system then indicates whether a safety device, such as crossing gates, lights, bells, visual, audio or physical warnings, and combinations thereof, should be activated.

FIG. 1 shows a rail line sensing and safety system (RLSSS) 2 according to an embodiment of the disclosure. The rail line sensing and safety system 2 comprises at least one detection module (DM) 4, at least one remote module (RM) 6, and at least one control module (CM) 8. Typically, the rail line sensing and safety system 2 will include two detection modules and two remote modules, one of each located on each side of a safety device 10; however, it should be noted that the rail line sensing and safety system 2 may contain more detection modules and remote modules. Typically, the rail line sensing and safety system 2 will include a single control module 8, adapted to accept signals sent from multiple remote modules 6, however, it should be noted that the rail line sensing and safety system 2 may contain more than one control module 8. Additionally, although the following description may refer to the safety device 10 as a crossing gate or other type safety device, it should be understood that the safety device 10 may comprise many types of safety and warning devices, such as crossing gates, lights, bells, visual, audio or physical warnings, and combinations thereof.

The detection modules 4 are each generally connected, in close proximity, with their closest remote module 6, for example by a hard-wired connection 12. In one example, the detection module 4 is hard-wired by a short cable 12 to the remote module 6, instead of utilizing a wireless connection. One benefit of a hard-wired connection, instead of a wireless connection, is that the hard-wired connection can be used to feed power, in addition to electrical signals, to the detection modules 4. In this setup, the detection modules 4 may be powered by one or more solar panels 312, battery packs 322, and a power control module that are part of the closest remote module 6 (see FIGS. 19A, 19B and 20). Alternatively, in this setup, the detection modules 4 may be powered by a power source located in or near the control module 8, provided that the wireless link 14 is replaced by a wired connection.

In operation, the detection module 4 detects a vehicle traveling on the rail 11 and sends one or more signals, for example, by a wired communication link 12, to a nearby remote module 6. The remote module 6 contains circuitry that processes signals received from the detection module 4. The remote module 6 then transmits one or more signals to the control module 8, for example by a radio link 14. In some installations, the connection between the remote modules 6 and the control module 8 may be by a wired connection instead of a radio link. The control module 8 also operates in communication, for example by a wired communication link 16, with a safety device 10, either directly or indirectly as a backup or supplement to an existing sensing and safety system (ESSS).

The detection modules 4 are mounted a distance 9 down the track from the centerline 7 between the two safety devices 10. This distance is typically between 3,800 feet and 4,500 feet, although other distances may allow the detection modules 4 to function properly. In general, the greater the distance 9, the more time is allowed for transmission of the wireless communications, and more transmission time provides additional operating margin to be sure that, after the vehicle passes a detection module 4, the safety device 10 then engages before (for example, approximately 30 seconds in advance) the vehicle traveling on the rail reaches the safety device 10. As one example, the nominal distance of 4,000 feet has been tested and has proved to offer a beneficial operating margin.

The remote modules 6 are generally installed at the same distance 9 down the track that the detection modules 4 are installed, although the installation location of the remote modules 6 may vary.

FIGS. 3-6 show a sensing device, also referred to as a detection module (DM) 4, according to the disclosure. The detection module 4 is designed to reliably detect if a wheel, for example, of a rail vehicle has passed over a specific location on a rail, and if so the detection module 4 may determine the direction and speed at which the vehicle was traveling. It is also possible that the detection module 4 may be configured to detect the presence of another part of a rail vehicle instead of a wheel, for example an axle.

The detection module 4 is comprised of a sensor package 114, two discreet magnetic or inductive sensors 102, signal processing circuitry 104 located near the sensors, a mounting system 106, and a wire conduit 107 and wire hole 108 to channel wires out of the sensor package 114. Sensor package 114 includes an upper casing 112 and a lower casing 110 that when affixed together, create a cavity between the two casings 112, 110. Sensor package 114 houses, inside this cavity, the signal processing circuitry 104 and the two sensors 102, along with any hardware required to mount the sensors 102 inside the package 114, such as brackets, gaskets, screws, washers, etc. Optionally, the sensor package 114 may house other standard components such as an analog-to-digital converter.

Figure 4:
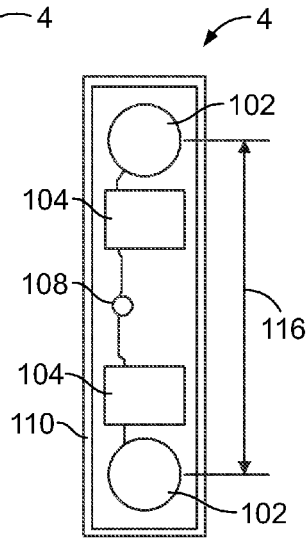
FIG. 4 shows a bird's eye schematic view of a detection module.
Figure 5:
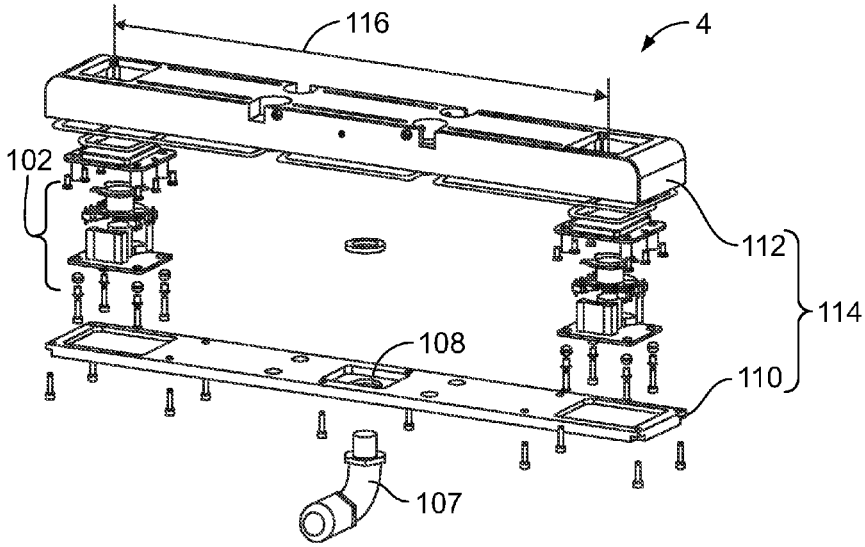
FIG. 5 shows an exploded, angled side view of a detection module.
Figure 6:
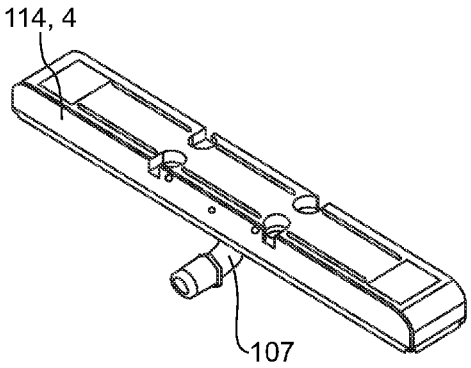
FIG. 6 shows an angled top view of a detection module.

The two discrete sensors 102 of the detection module 4 are mounted, inside the package 114, at a fixed spacing 116 from each other (see FIGS. 4 and 5). This spacing 116 allows the two sensors 102 and related circuitry to sense time-separated detection events, allowing for the calculation of the speed and direction of a passing rail vehicle. While the following descriptions discuss only two sensors per detection module, it should be understood that a detection module 4 (and its package 114) could contain more than two sensors 102, sometimes referred to as a "sensor array". Additionally, although this disclosure refers separately to sensors 102 and circuitry 104, it should be understood that there may not be a defined separating point between a sensor 102 and its associated circuitry 104. For example, the sensor 102 may include, as explain below, a coil of wire and the circuitry 104 may include a signal processing circuit, but the sensor item 102 may also include some or all of the circuit components of circuitry item 104. If sensor item 102 contains all the circuitry components of item 104 then the two items would, in effect, be one module, including the sensor item 102 and the circuitry item 104.

Figure 7:
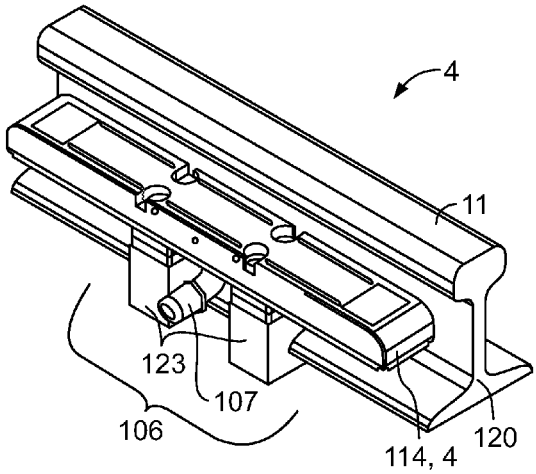
FIG. 7 shows an angled top view of a detection module, mounted to a rail.
Figure 8:
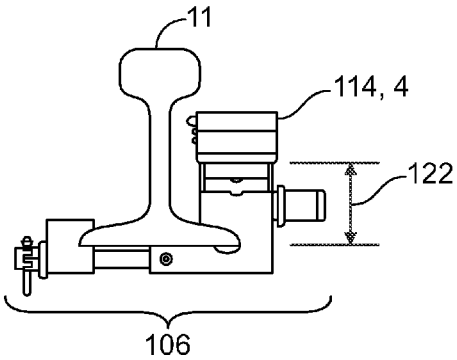
FIG. 8 shows a cross-sectional side view of a detection module, mounted to a rail.
Figure 9:
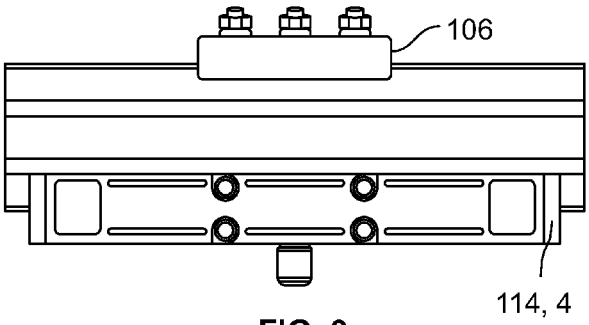
FIG. 9 shows a bird's eye view of a detection module, mounted to a rail.

Referring to FIGS. 7-9, the detection module sensor package 114, including all of its inner components, is mounted onto a rail 11 (see also FIG. 1) utilizing a rail attachment device. The rail attachment device can be a clamp, flange, bracket, or other fastener. Preferably, the detection module sensor package 114 is attached to the rail with an energy absorbing mounting system 106. The mounting system 106 may include a clamp, flange, bracket, or other fastener for attaching the sensor package to a rail 11. In one example, this mounting system 106 clamps to the lower flange 120 of a rail 11, and suspends the detection module sensor package 114 up off the rail flange 120 a vertical distance 122.

Figure 10:
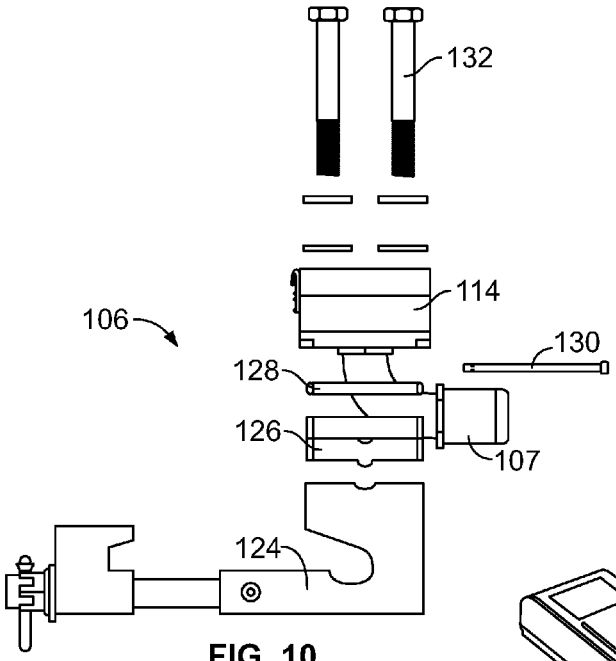
FIG. 10 shows an exploded side view of a mounting system for a detection module.
Figure 11:
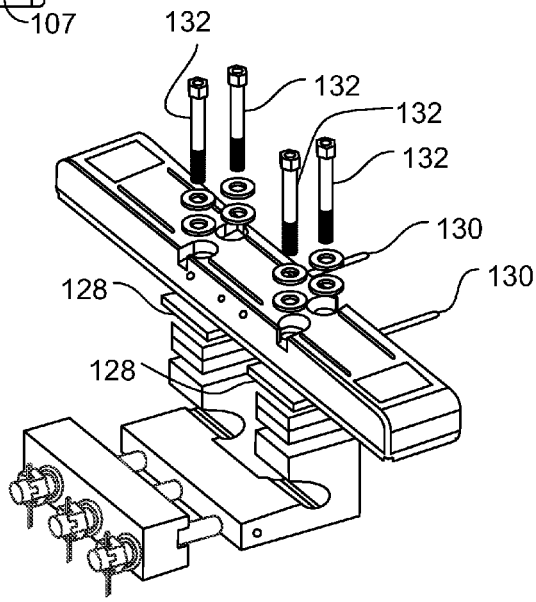
FIG. 11 shows an exploded, angled top view of a mounting system for a detection module.
Figure 12:
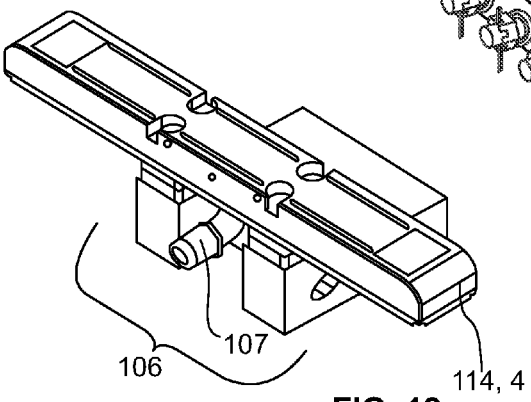
FIG. 12 shows an angled top view of a detection module and a mounting system.
Figure 13:
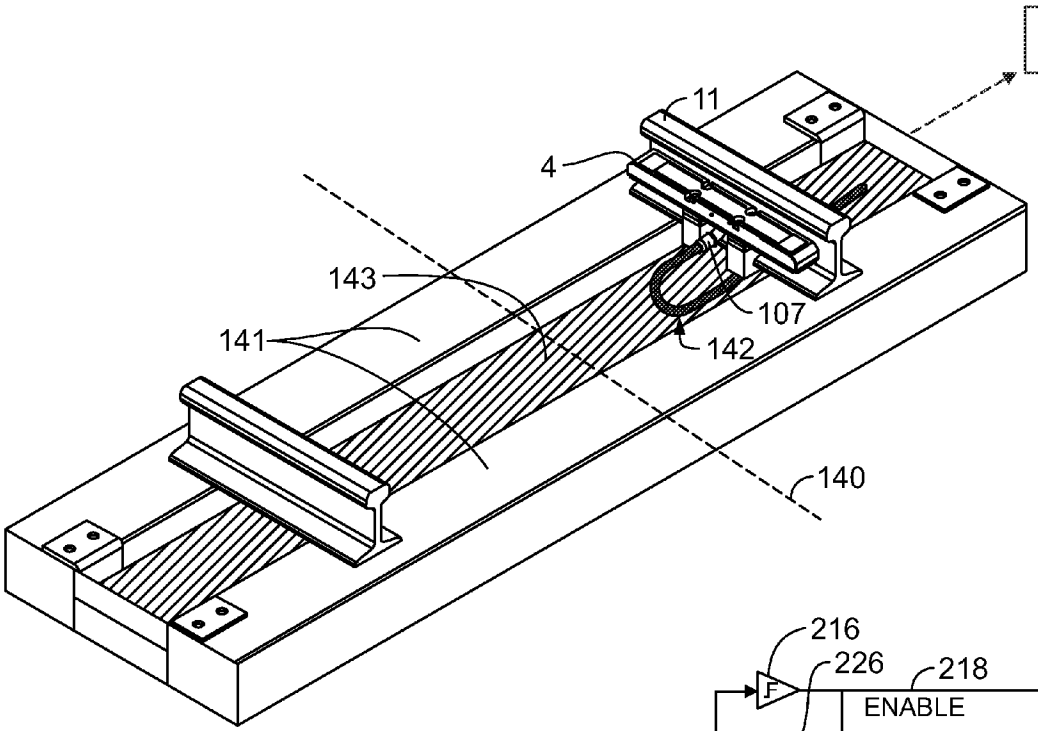
FIG. 13 shows an angled top view of a detection module, mounted to a rail.

FIGS. 10-11 show a more detailed example of an energy absorbing mounting system 106. The mounting system 106 may be further comprised of a clamp assembly 124, aluminum shims 126, vibration absorption pads 128, lock pins 130 and cap screws 132. The detection module sensor package 114 is mounted on top of the absorption pads 128, which are designed to absorb vibrations from the rail 11. The absorption pads 128 may be made of a variety of vibration absorbing materials, including rubber or some other elastomeric material. Lock pins 130 are inserted horizontally from the side of the package 114 into the detection module sensor package 114 and rest against the heads of the four cap screws 132. The cap screws 132 apply clamping force to the package 114 to fasten the package 114 to the rest of the mounting system 106 and to fasten the parts of the mounting system 106 together. In one example, the four cap screws 132 are not tightened conventionally, but are instead tightened to a specific rotation angle after contact is made between the sensor package 114 and the absorption pads 128. The cap screws 132 are then prevented from unscrewing by the lock pins 130 which are inserted once the mounting system 106 is assembled. The lock pins 130 key on the heads of the cap screws 132, preventing the cap screws from rotating.

Referring to FIGS. 7-13, once the detection module sensor package 114 has been mounted to a rail 11 using a mounting system 106, for example, the wire conduit 107 has room to freely curve in the gap that exists between the two pillars 123 of the mounting system 106. The wire conduit 107 attaches to the underside of the lower casing 110 of the package 114 at the location of the wire hole 108 (see FIGS. 5 and 10). From that point, the wire conduit 107 curves from a generally vertical downward direction to a generally horizontal direction toward the center of the railway 140. From there, a water-tight tube 142 adapted to enclosing wires attaches to the wire conduit 107. The tube 142 curves from a generally horizontal direction downward and then back on itself. Tube 142 then runs through a channel 143 created by and between rail ties 141, below the rail 11, and then away toward the nearest remote module 6. The combination of the wire hole 108 (see FIGS. 3-4), the wire conduit 107 and the tube 142 creates a path whereby wired connections may run from inside the detection module sensor package 114 out to the nearest remote module 6. Although the preceding explanation refers to specific angles and curving of the wire conduit 107 and tube 142, it should be understood that other angles, curvings, and wiring paths may work.

Signal processing circuitry 104 is disposed inside the detection module sensor package 114, near the sensors. It should be understood that while some processing of the signals produced by sensors 102 may be done by circuitry 104 contained in the detection module sensor package 114, all or some of the processing may be done by circuitry or firmware contained in the remote module 6. The sensors 102, in combination with circuitry generally located inside the detection module 4, detect the speed of a vehicle travelling on the rail 11 by measuring the time between sensor events. Likewise, the sensors and circuitry measure direction by looking at which sensor event occurred first. A "sensor event" refers to a signal produced by an individual sensor 102 that the circuitry, located either inside the detection module, inside the remote module, or both, determines fulfills the appropriate detection criteria, that is, the circuitry determines whether the detection event is valid.

Thus, in operation, when a vehicle passes at a distance above the first and second sensors 102 of a detection module 4, the presence, speed and direction of the vehicle are calculated with circuitry located within the detection module sensor package 114, within the remote module 6, or a combination of both. The detection module 4 produces and sends to the remote module 6 one or more output pulses 323 (see FIG. 20) predictably synchronized with the passing of the vehicle traveling on the rail. These output pulses 323 are produced utilizing sensors 102 and other circuitry 104 disposed inside the detection module sensor package 114. In general, a successful sequence of sensor pulses is referred to as a "transit."

Detection events are generated by the detection modules 4 and/or remote modules 6 at the start and end of a vehicle passing by a detection module 4 on the rail 11, and the remote module 6 then transmits information about these detection events as signals to the control module 8. Alternatively, the detection modules 4 and remote modules 6 may generate events and transmit signals for each discrete axle of the vehicle.

Considering the inner workings of a detection module 4, sensors 102, can be one of several different types of proximity sensors, such as Piezo electric sensors, magnetic sensors or inductive sensors. In one embodiment of the disclosure, sensors 102 utilize active inductive sensor technology that is self-compensating and resistant to drift because it constantly resets its trip threshold.

Figure 14:
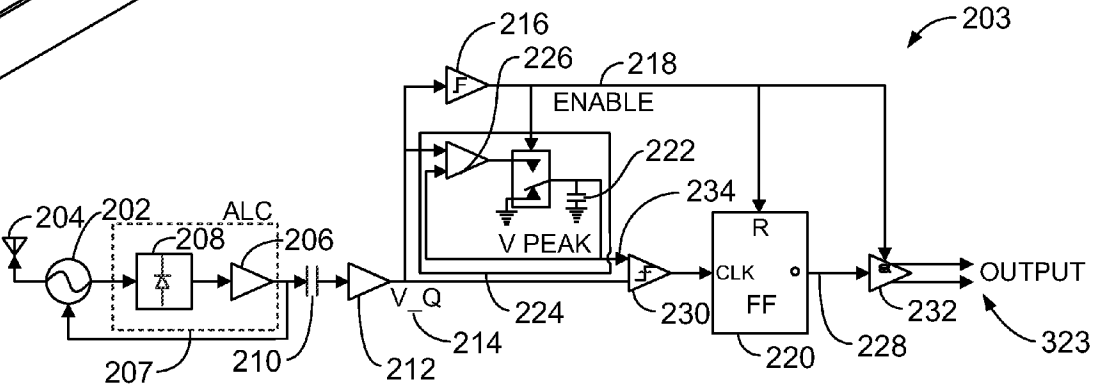
FIG. 14 shows a circuit diagram of circuitry that may be associated with sensors located inside a detection module.

FIG. 14 shows a high-level circuit diagram of circuitry 203 associated with a sensor 102. Circuitry 203 constitutes at least some of the total circuitry 104 that is associated with a sensor 102. Circuitry 203 includes an oscillator 202, for example a Colpitts oscillator. In general, an oscillator is an electronic circuit that produces a repetitive electronic signal, often a sine wave or a square wave. An oscillator circuit often consists of an inductor and a capacitor connected together in the form of a resonant tank. Charge flows back and forth between the capacitor's plates through the inductor, so the circuit can store electrical energy oscillating at its resonant frequency. However, there are small energy losses in the circuit, and so an amplifier compensates for those losses and supplies the power for the output signal.

Figure 15:
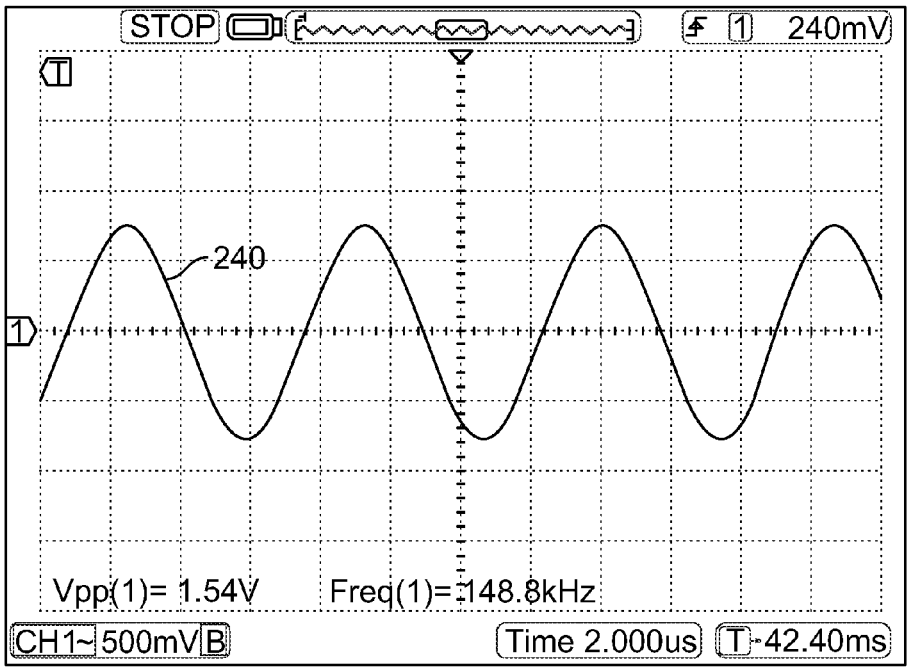
FIG. 15 shows a sinewave that may be produced by an oscillator that may be part of the circuitry associated with sensors located inside a detection module.

The oscillator 202 operates in continuous wave (CW) mode, for example in the 140-180 kHz range, which is defined by characteristics of the resonant tank comprised of an inductive proximity "pickup coil" 204, an RF rectifier 208 and an automatic level control (ALC) amplifier 206. FIG. 15 shows an example of a sinewave, as illustrated by trace 240, produced by the oscillator 202. In this example, the sinewave can have a peak-to-peak voltage value of approximately 1.4 Volts and a frequency of approximately 148.8 KHz, which is close to the lower end of the range disclosed above.

Pickup coil 204, essentially an inductor, includes wire wound on one half of a ferrite core, a PQ-style ferrite core for example, so that an AC magnetic field generated by the coil extends outward a distance (the coils sensing area), extending above the sensor for example. In this respect, the coil may magnetically couple with nearby metallic objects. It should be understood that other core styles may be used instead of a PQ-style ferrite core. For example, a variant of a "pot core" could be used. A pot core has a magnetic structure that almost completely surrounds the winding of wire, and only small slots are present in the structure to allow wires to enter and/or exit. This magnetic structure tends to contain the magnetic field in a more controlled fashion. Other variants of pot cores that may be applicable to this implementation include ER, DS, RM, and EP cores.

Construction of the coil is tailored to achieve relatively high Q factor (Quality Factor), which is a measure of energy loss at the operating frequency. Pickup coil 204 preferably utilizes a special type of wire, called "Litz Wire", to achieve high sensitivity and very low power consumption. Litz Wire is comprised of many small-diameter conductors in parallel such that the combined skin effect loss of the conductors is significantly reduced compared to the skin effect loss experienced by other types of wire. Less skin effect loss results in, among other benefits, lower power consumption. More specifically, in regards to the circuitry of the detection module 4, less skin effect loss results in "low-losses" such that the oscillator achieves a high Q resonance with minimal power. Thus, the use of Litz Wire allows the pickup coil 204 to achieve a Q factor as high as possible.

Because the pickup coil 204 has a high Q factor when no detection object is present in the pickup coil's sensing area, very little energy needs to be added in each oscillation cycle to sustain oscillations, and thus the micropower operation of the circuitry 203 in "Idle" state (no object detected) is very low (less than 1 milliwatt). In operation, when a metallic object, for example a wheel of a vehicle traveling on a rail 11, approaches the pickup coil 204 and intrudes the pickup coil's 204 sensing area, the energy loss of the oscillator 202 will increase because some of the energy will be coupled into the object and lost as heat. The amount of energy loss is dependent on both the magnetic properties of the intruding object, and the distance between the pickup coil 204 and the object.

This increased energy loss exhibits itself as a drop in the Q factor of the pickup coil 204. As the Q of the pickup coil 204 drops due to approach of an object, the magnitude (i.e. amplitude) of the oscillator's 202 oscillations starts to decrease proportionally. In response, circuit 203 utilizes an ALC loop 207, consisting of a RF rectifier 208 and an ALC amplifier 206, to ensure that just enough energy is delivered to the resonant tank of oscillator 202 to sustain oscillations of relatively constant magnitude (i.e. amplitude) for all reasonable values of Q. As the oscillation magnitude (i.e. amplitude) drops, the ALC loop tries to compensate via negative feedback action by producing a DC voltage proportional to the magnitude (i.e. amplitude) of the oscillator's 202 output, which is then amplified and used to control the operating point of the oscillator 202 by increasing the oscillator's 202 operating current. More specifically, a decrease in oscillations magnitude (i.e. amplitude) causes the DC voltage produced by the rectifier 208 to also decrease. In response, the ALC amplifier 206 increases the current through the oscillator's transistor (essentially increasing the amount of energy which is injected into the resonant tank) until the magnitude (i.e. amplitude) of oscillations is back at the predefined level (negative feedback).

In other words, a reduction in the pickup coil's Q-factor, caused by an intruding object is proportionally represented by an increase in the ALC's drive voltage. The closer the object is to the coil's sensing surface, the higher are the losses due to magnetic coupling, the higher the ALC control voltage will be, while the magnitude (i.e. amplitude) of the RF oscillations remains relatively constant. Therefore, output voltage of the ALC amplifier 206 can be treated as a close representation of the pickup coil's Q, and consequently, representation of the detection object's proximity. For a dynamic (moving) object, like a railcar wheel, the profile of variations in the ALC control voltage would therefore closely follow the wheel's proximity curve.

A capacitor 210 is typically located between the ALC control voltage (i.e. the output of amplifier 206) and amplifier 212. Capacitor 210 may act as a "DC-blocking capacitor" to the ALC control voltage such that it removes the DC component (DC offset), in whole or in part, from the AC/DC mixture, allowing only (or primarily) the AC component to pass through to amplifier 212. Thus, the capacitor 210 ensures that only (or primarily) variable signals caused by moving (dynamic) objects are passed downstream in circuitry 203, while static DC level shifts (drift) that may be caused by interference from static or slow-moving objects (for example, the sensor package or the rail) are blocked, in whole or in part. In this respect, only (or primarily) the AC component of the ALC control voltage variations, which indicates the proximity of a high-speed detection object, is amplified by amplifier 212.

In certain embodiments where the circuitry 203, specifically capacitor 210, filters out all or some of the DC voltage drift, this filtering feature may provide a benefit over older proximity sensors that may just compare a proximity-based voltage to a static threshold, using the threshold to determine whether an object is sufficiently close. Accounting for DC voltage drift, like the circuitry 203 does in these embodiments, may increase the accuracy and repeatability of the proximity sensing.

Although the previous description explains a feature whereby the circuitry 203, specifically capacitor 210, may completely filter out the DC voltage from the AC/DC mixture, it should be understood that some embodiments may allow some DC voltage to pass downstream. In these embodiments, the ability to sense the DC aspect, or at least very low frequency components, may be useful.

While the circuit 203 is in its "Idle" state (no object detected), the profile of the V_Q voltage 214 is a flat line, close to the circuit's virtual ground level. The threshold of comparator 216 is chosen such that the ENABLE signal 218 (i.e. the output of comparator 216) is inactive in the "Idle" state, holding the output 228 of the flip-flop 220 in a "Reset" state and the storage capacitor 222 of the peak-and-hold circuit 224 discharged.

In operation, the passing of a railcar wheel above the pickup coil 204 introduces a bell-shaped variation in the V_Q voltage 214. In order to provide consistent synchronization of the output pulses 323 with the top of the bell-shaped voltage curve (which coincides, for example, with a wheel's closest location), circuitry 203 utilizes a peak-and-hold detector, whereby the following sequence of events transpires in circuitry 203: (1) As soon as the V_Q voltage 214 rises significantly above the noise level of the Idle state, comparator 216 raises the ENABLE signal 218 and keeps it active until the V_Q voltage 214 falls back under the detection threshold, which occurs as the detection object recedes. (2) The active ENABLE signal 218 activates in turn the peak-and-hold circuit 224 by connecting its storage capacitor 222 to the output of the peak detector 226 in the peak-and-hold circuit 224. Also, flip-flop 220 is released from the "Reset" state (however, the state of output 228 does not change until a trigger pulse is generated by comparator 230). Differential driver 232 is also activated at this point. (3) On the rising slope of the V_Q voltage 214, the output (V_PEAK) 234 of the peak-and-hold circuit 224 follows the V_Q voltage 214 closely, with a slight lag. Comparator 230 maintains its low output state, since the V_Q voltage 214 input to the comparator 230 is always slightly above the V_PEAK 234 input.

Figure 18:
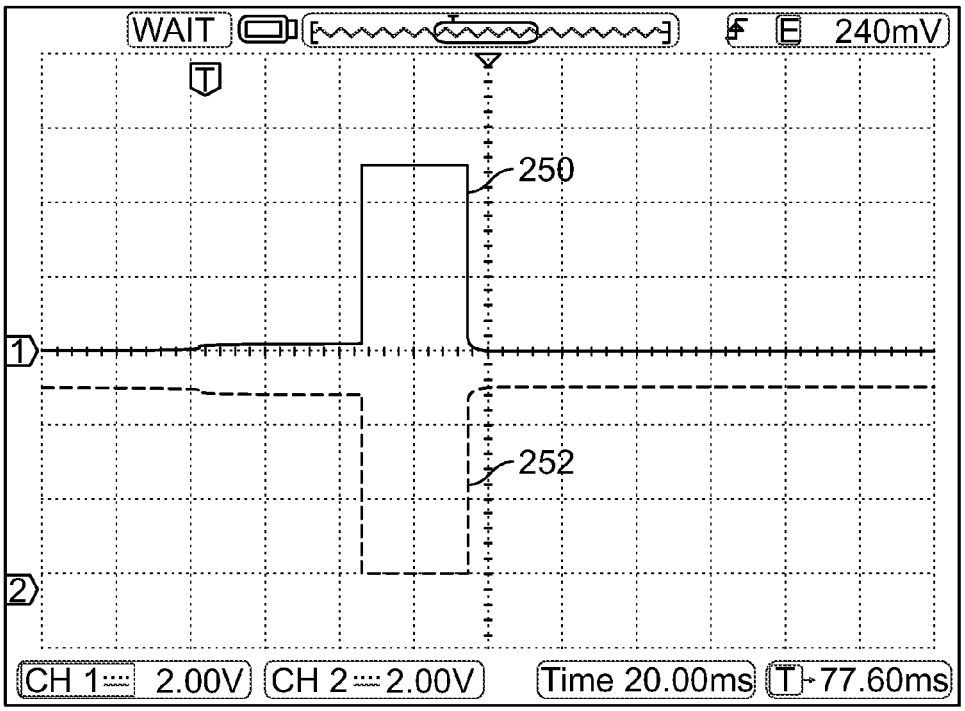
FIG. 18 shows output pulses that may be generated by circuitry associated with sensors located inside a detection module.

(4) When the V_Q voltage 214 tops off (i.e., the top of the bell-shaped voltage curve) and begins to fall back, the peak-and-hold circuit 224 can no longer follow it and holds the maximum level that V_Q voltage 214 has reached in this detection cycle. As soon as the divergence between the falling V_Q voltage 214 and the "frozen" V_PEAK 234 becomes large enough to overcome the hysteresis of the comparator 230, the comparator's 230 output state changes, producing a trigger pulse for the flip-flop 220. (5) Flip-flop 220 then changes its output state to "high", producing a pulse at its output 228, which is further converted to differential format by the differential driver 232. (6) This state is preserved until the V_Q voltage 214 drops below comparator's 230 detection threshold, which then terminates the flip flop's 220 output pulse and resets the circuit back into its "Idle" state, whereby circuitry 203 is ready for a next detection event. FIG. 18 shows an example of the output pulses 323 that result from the detection of a metallic object by the circuitry 203. The trace labeled 250 corresponds to one of the outputs of the differential driver 232 while the trace labeled 252 corresponds to the other output of the differential driver 232.

Figure 16:
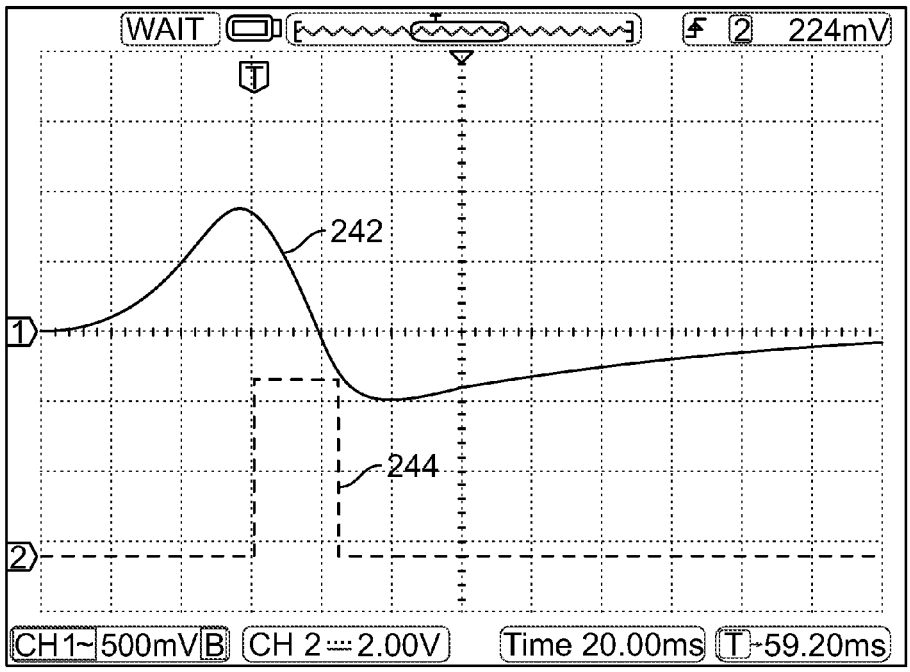
FIG. 16 shows a timing relationship that may result between a voltage in the circuitry, associated with sensors located inside a detection module, and one of the circuitry's output pulses.

Referring to FIG. 16, there is shown an example of the timing relationship that results between the V_Q voltage 214, which is illustrated by trace 242, and one of the output pulses 323, which is illustrated by trace 244, when the sequence of events described above transpires in circuitry 203. In this example, when a metallic object passes above the pickup coil 204 at a distance of approximately two inches (2"), the start of the pulse in trace 244 coincides with the peak of the bell-shaped curve of trace 242. In other words, the output pulse 323 that is generated indicates, by its starting time, the peak of the V_Q voltage 214 and, therefore, the moment at which the metallic object is closest to the sensor 102.

In the event that the oscillator 202 malfunctions or operates incorrectly because of a damaged inductive proximity pickup coil 204 or other defects that lead to a loss in oscillations, the voltage of the ALC loop will likely rise to the maximum or close to the maximum of the operating voltage range. The circuitry 203 can be configured to detect those instances, and when detected, circuitry 203 can be configured to force both outputs 323 from the differential driver 232 to zero (or another defined state), and generate a signal that indicates that a fault in the oscillator 202 has been detected.

With respect to the embodiment of circuitry 203 associated with sensor 102 illustrated by FIG. 14, the oscillator 202 can be built around a first transistor Q1 (not shown) and a voltage-controlled resistor (not shown) in the emitter path of Q1. The voltage-controlled resistor can be implemented using a second transistor Q2. The sinewave produced by the oscillator 202 is converted to DC by the RF rectifier 208 and applied to the input of the ALC amplifier 206 in such a polarity that an increase in the magnitude (i.e. amplitude) of oscillations results in a decrease in the output of the ALC amplifier 206 (V_ALC), thus reducing the conductance of the voltage-controlled resistor. Similarly, a decrease in the magnitude (i.e. amplitude) of oscillations results in an increase in the output of the ALC amplifier 206, which increases the conductance of voltage-controlled resistor. Therefore, any drop in the Q factor of the inductive proximity pickup coil 204 in response to the presence of a nearby metallic object can be compensated by the ALC loop by increasing the conductance of the voltage-controlled resistors, which reduces the emitter resistance in Q1. Since the base of Q1 can be kept at a fixed reference potential, a reduction of emitter resistance can cause the DC operating point to move such that there is an increased current draw and more energy is deposited into the resonant tank at each cycle. A thermally sensitive resistor (not shown), also referred to as a thermistor, can be used with the oscillator 202 to maintain the voltage of the ALC loop at approximately the middle of the operating voltage range during "Idle" operation.

Also with respect to the embodiment of circuitry 203 illustrated by FIG. 14, the amplifier 212 can be configured or be operable to have a sufficiently high gain, for example 30 dB at 25 degrees Centigrade, so that small variations in the output of the ALC amplifier 206 can be amplified by the amplifier 212 to an magnitude (i.e. amplitude) of approximately a few hundred millivolts during normal detection events. A thermistor (not shown) associated with the amplifier 212 can compensate or neutralize the effect that the thermistor in the oscillator 202 has on the overall gain of the analog track of the circuitry 203.

Figure 17:
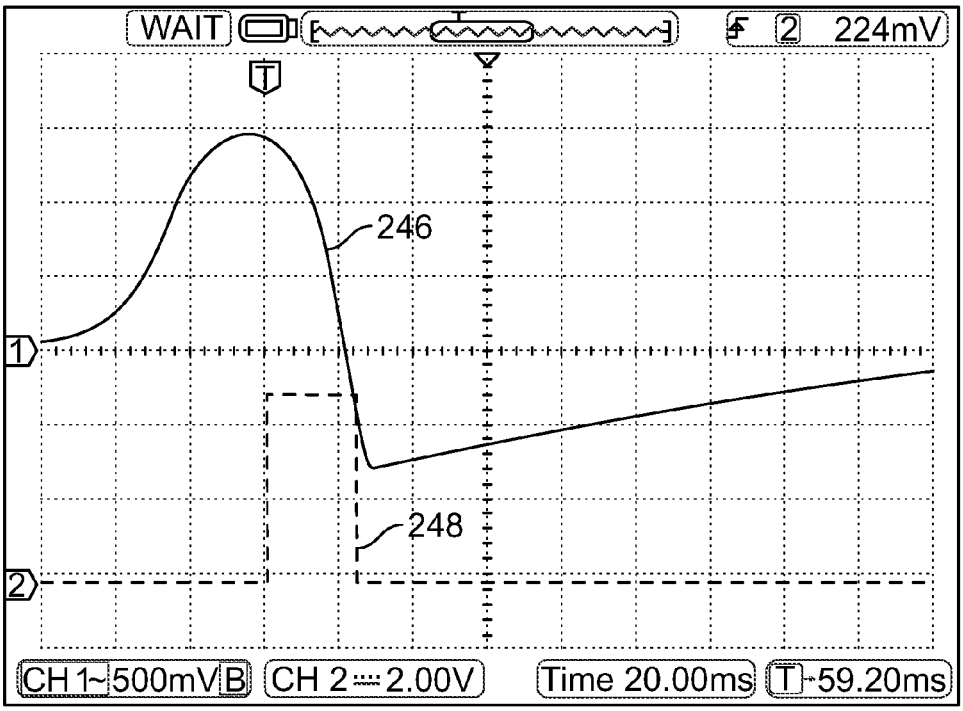
FIG. 17 shows a timing relationship that may result between a voltage in the circuitry, associated with sensors located inside a detection module, and one of the circuitry's output pulses.

Moreover, because of the high gain of the amplifier 212, if the sensor 106 is mounted so that the wheels pass very close to the pickup coil 204, the output from the ALC amplifier 206 can cause the output of the amplifier 212 to saturate, clipping V_Q voltage 214. Such clipping could cause the generation of incorrectly positioned differential output pulses 323. To address this possible condition, a Zener diode (not shown) can be placed in a feedback path of the amplifier 212 to give it a logarithmic transfer characteristic for large-magnitude (i.e. large-amplitude) signals. As a result, a strong proximity voltage signal would be somewhat flattened at the top instead of being hard-clipped, allowing for correct operation of the follow-up peak detection. FIG. 17 shows an example of the timing relationship that results between the V_Q voltage 214, which is illustrated by trace 246, and one of the output pulses 323, which is illustrated by trace 248, when a metallic object passes above the inductive proximity pickup coil 204 at a distance of less than one inch (1"). In such instance, the logarithmic transfer characteristics of the amplifier 212 flatten the top of the V_Q voltage 214 such that the synchronization of the output pulse 323 and the V_Q voltage 214 is not exact but produces an acceptable result.

Figure 19A:
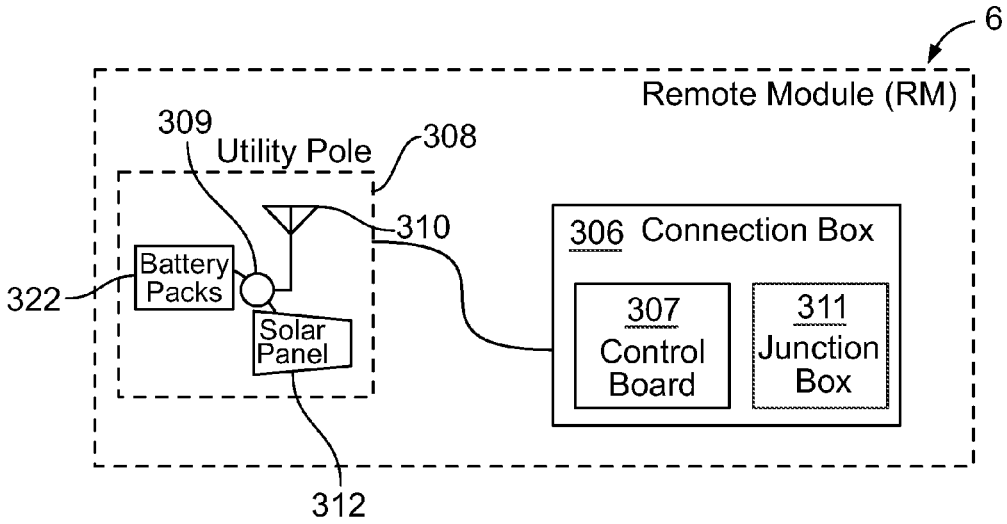
FIG. 19A shows a block diagram of a remote module, according to the disclosure.
Figure 19B:
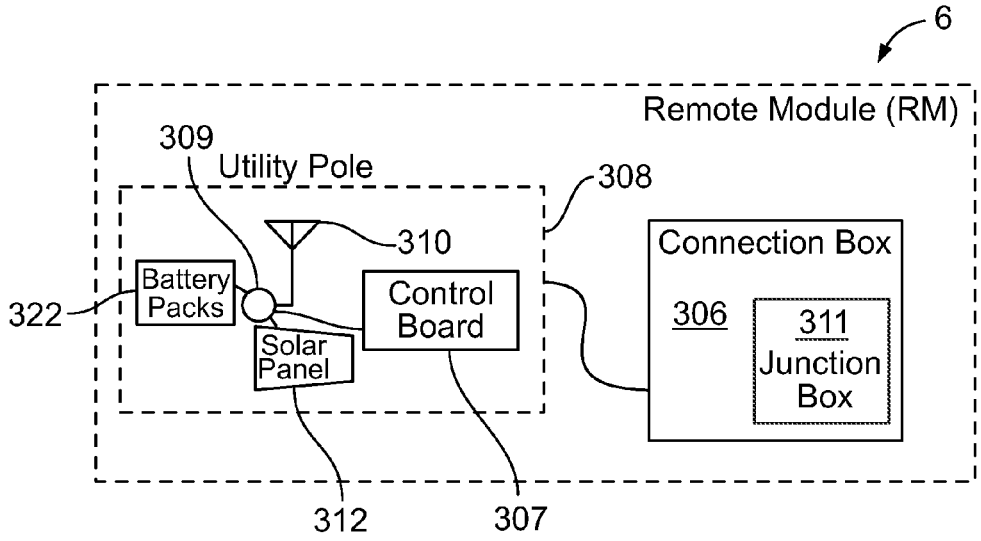
FIG. 19B shows a block diagram of a remote module, according to the disclosure.

FIGS. 19A and 19B show the remote module (RM) 6. The primary function of the remote module 6 is to receive and process signals received from the detection module 4 and to send appropriate signals to the control module 8. The remote module 6 includes 2 main subcomponents, a connection box 306 that is typically located close to the tracks, and a utility pole 308 that is typically located further away from the tracks and connected by an underground connection (see FIG. 22) to the connection box 306.

Referring to FIG. 19A, the connection box 306 may contain a junction box 311 and a control board 307, preferably enclosed in an environmentally sealed enclosure. Referring to FIG. 19B, the control board 307 may also be mounted, preferably within an environmentally sealed enclosure, on the utility pole 308, further away from the tracks, instead of being disposed inside a structure (for example, connection box 306) that is mounted close to the tracks.

The junction box 311 contains mainly adaptors and connections to create a removable connection to the detection module 4, which aids in the installation and removal of the detection module 4, for example, removal of the detection module 4 to perform track maintenance. It should be understood that although FIG. 19A shows the junction box 311 contained within a structure (for example, connection box 306) that also contains the control board 307, the connections of the junction box 311 and the junction box itself may be contained either inside the structure that houses the control board 307, outside that structure, or a combination of both. Additionally, referring to FIG. 19B, in the example where the control board 307 is mounted on the utility pole 308, the junction box 311 may be the only component located near the tracks, such that the junction box 311 is not actually contained within a separate box (for example, connection box 306) as shown in FIG. 19B, but instead the junction box 311 would stand alone as the only module near the tracks, such that it is directly connected to the utility pole 308.

Figure 20:
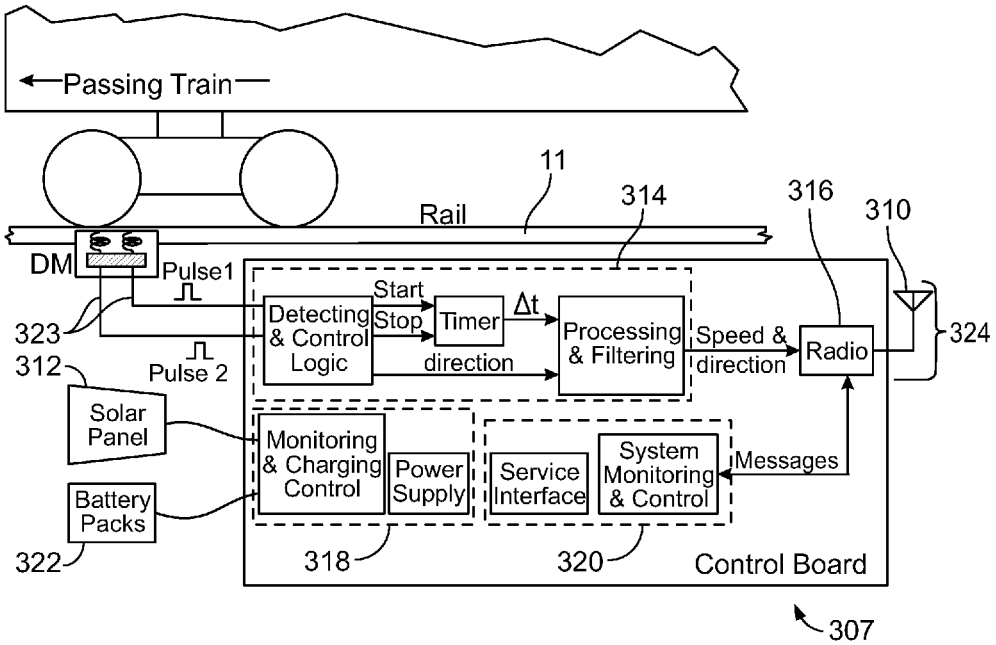
FIG. 20 shows a block diagram of a remote module in relation to a detection module and a rail.

Referring to FIG. 20, the control board 307 contains most or all of the circuitry components contained within the remote module 6. In one example, all of the circuitry components of the remote module 6 are disposed on a single circuit board. The control board 307 can contain circuitry 314 adapted for processing signals received from the detection module, a wireless radio transmitter circuit 316, a power module 318, and a monitoring and control module 320. The circuitry 314 is in connection with the detection module 4 (see FIG. 20) and further includes signal detecting and control logic, a timer, and signal processing and filtering logic. The circuitry 314 is also in communication with the radio transmitter circuit 316, and may send it vehicle presence, speed and direction information of a nearby vehicle. The radio transmitter circuit 316 is in connection with a radio transmitter antenna 310, located on the utility pole 308. The power interface 318 may be connected to power components contained on the utility pole 308, including one or more solar panels, battery packs or both. Furthermore, the power interface 318 may contain power monitoring and charging logic as well as a power supply to power the other components contained in the connection box 306 and optionally to feed power to the detection module 4. The monitoring and control module 320 further contains a service interface and a system monitoring and control unit that may communicate system information (for example, diagnostics about the detection module and the remote module) to the radio transmitter 316.

It should be understood that while some processing of the detection module sensor signals may be done inside the detection module sensor package 114, all or some of the processing may be done by circuitry contained in the remote module 6. Typically, the detection module produces one or more output pulses 323 predictably synchronized with passing of a vehicle on the rail. Then circuitry inside the detection module 4 or inside the remote module 6 or both computes whether the signals generated by the detection module sensors fulfill the appropriate detection criteria, that is, whether a vehicle detection event is valid. Detection events are generated by the detection modules and remote modules at the start and end of a vehicle traveling on the rail, and the remote modules transmit these detection events as signals to the control module. Alternatively, the detection modules and remote modules may generate events and transmit signals for each discrete axle of the vehicle.

FIG. 19A shows a utility pole 308, which includes a wireless radio transmission antenna 310, a solar panel 312, and battery packs 322. It should be understood that even though this disclosure and FIG. 19A refers to a utility "pole" 308, the utility pole 308 is actually comprised of a physical pole 309 as well as the devices that are mounted to the pole 309, such as the wireless radio transmission antenna 310, the solar panel 312, and the battery packs 322. Throughout this disclosure, the phrase "on the utility pole 308" shall be understood to mean either mounted on the physical pole 309 or located in close vicinity to the physical pole 309. Additionally, a variety of styles of physical poles may be used, such as a hinged metal pole that allows erection of the antenna and solar panel without requiring a lift truck, such that all work on the mounted components can be done at ground level.

The solar panel 312 derives energy from the environment, and stores that energy in the battery packs 322 or other rechargeable batteries. The battery packs 322 are enclosed in a vented enclosure that is adapted to be mounted on a pole. Furthermore, the battery packs 322 are sized for over 30 days of operation in the event the solar cell is damaged or otherwise incapacitated. Together, the solar panel 312 and the battery packs 322 provide power to the other modules that make up the remote module and detection module.

Referring to FIG. 20, the transmitter 324, which includes a radio transmission antenna 310 and a radio transmitter circuit 316, processes signals generated by the remote module 6 and transmits signals to control module 8 utilizing either a wired or a wireless communication. For example, a wireless communication could be established by a frequency hopping radio, transmitting at a radio frequency (RF) such as a 900 Mhz band. In another example, a wireless communication could be established using a wider cellular interface and cellular network. Frequency hopping radios are preferable for wireless communications over a distance of three miles or less. For longer distances, it may be preferable for the wireless communication to be established over licensed frequencies that allow higher power transmissions than are allowable on unlicensed frequencies. Additionally, for longer distances, the wireless communication may be established by an interface to a cellular network.

Transmitter 324 is mainly referred to, throughout this disclosure, as a "transmitter" because it typically operates to transmit signals. Likewise, transmission antenna 310 and transmitter circuit 316 typically operate to transmit signals. However, it should be understood that transmitter 324, transmission antenna 310 and transmitter circuit 316 may also operate to receive signals, and in this respect they may actually be transceiver components. Thus, it should be understood that although these components (324, 310, 316) are referred to throughout this disclosure as "transmitter" or "transmission" components, they may actually be transceiver components.

One benefit of the wireless antenna and solar panel features of this embodiment is that installation of the rail line sensing and safety system 2 is much easier than if, for example, wired connections had to be run from the remote module to the control module or from a power source to the remote module. This wireless and solar powered installation is especially useful in remote locations where currently, installing rail sensing systems is cost prohibitive due to lack of power and interface infrastructure.

Although the wireless installation is often preferred, in certain instances, it may be desirable to install a "wired" version of the rail line sensing and safety system 2. This wired version may be preferable in certain environments or circumstances where the wireless space is "noisy" or where other obstructions may attenuate a wireless signal or link In this wired configuration, the wireless radio links 14 (the wireless radio transmitter 324 and the wireless radio transceiver 405 are replaced by wired connections, for example, utilizing a twisted wire pair and differential drivers, such as EIA-485. Likewise, in a wired configuration, the solar panels 312 and battery packs 322 on the utility pole 308 may be eliminated, and instead, DC power may be fed to the remote modules and detection modules through the wired connection from the control module, for example, utilizing a wire pair as the wired connection. In the wired installation, the power supply at the control module may still include solar panels and battery packs, or may include a more permanent power supply from a power generator.

The remote module 6 may also utilize power saving features. For example, the remote module 6 may operate in a mode whereby processing circuitry, for example circuitry included on control board 307, is at times put to "sleep." Because the wireless transmitter 324 in the remote module 6 has sufficient built-in intelligence to maintain a wireless link without requiring constant transmission and processing of substantive signals about vehicles, the processing circuitry in the remote module 6 may sleep when there is inactivity in the system. The wireless link is maintained autonomously while the processing circuitry is powered down. If the remote module 6 needs to communicate substantively with the control module 8, for example with a status update or a detection of a vehicle on the rail, the processing circuitry in the remote module 6 may be signaled to "wake up."

Figure 21:
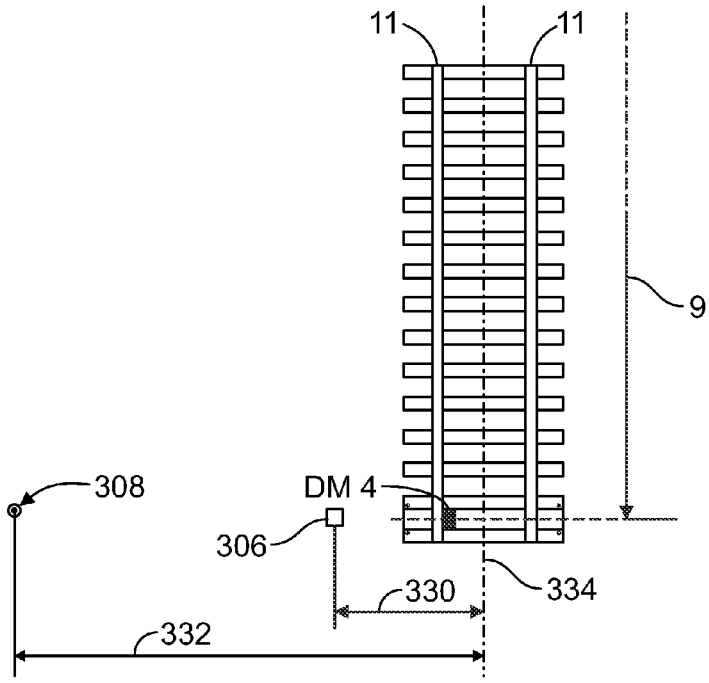
FIG. 21 shows the installation location of at least some subcomponents of a remote module.
Figure 22:
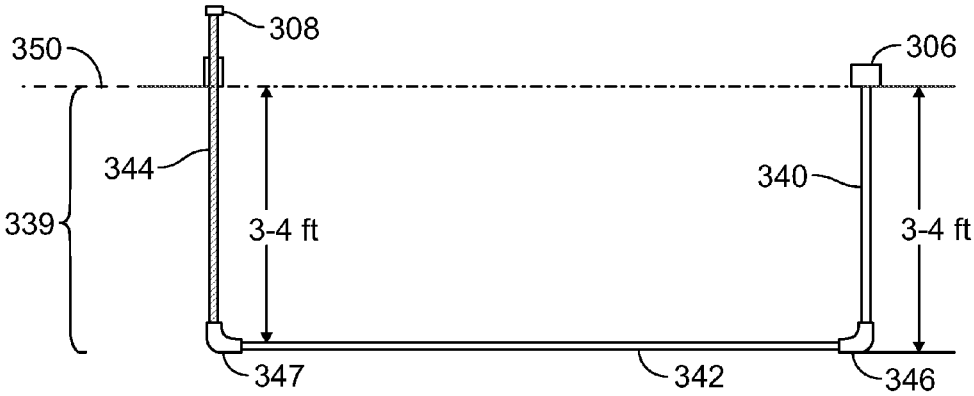
FIG. 22 shows the installation location of at least some subcomponents of a remote module.

FIGS. 21 and 22 show the installation location of the main remote module subcomponents (connection box 306 and utility pole 308) in relation to a rail line 11, a detection module 4 and each other. The connection box 306 and utility pole 308 are each located a distance 330, 332 (respectively) away from the center line of the rail 334 in a perpendicular direction to the center line 334. Distances 330 and 332 may vary. The utility pole 308 may be installed a distance away from other remote module components (located in the connection box 306 near the rail 11) if, for example, there is not enough space near the rail 11 to install the utility pole 308, with its antenna, battery packs and a solar panels. Other factors that may determine the location of the utility pole include the need to establish a sufficient wireless link and the need for access to direct sunlight. In one example, the connection box 306 is located a distance 330 of approximately 8 feet from the rail, and the utility pole 308 is located a distance 332 of approximately 25 feet from the rail.

The connection box 306 and the utility pole 308 are installed at approximately a distance 9 (see FIGS. 1 and 21) down the track from the centerline 7 between the two safety devices 10, approximately the same distance 9 at which the detection modules are installed. This distance is typically between 3,800 feet and 4,500, although other distances may allow the system modules to function properly.

Referring to FIG. 22, the connection box 306 and the utility pole 308 are connected by an underground conduit 339. The conduit may run in a variety of directions, angles and depths. Additionally, the conduit may be formed from a variety of materials such as metal, plastic and PVC. Furthermore, the conduit may be formed from a single piece of material, or from several segments joined together. In the example shown in FIG. 22, the conduit starts at the connection box 306 and extends, by a PVC segment 340, vertically downward below the line of the ground 350. At approximately a depth of 3 to 4 feet, PVC segment 340 connects by a 90 degree elbow 346 to another PVC segment 342. PVC segment 342 runs horizontally toward the utility pole 308, and once it reaches the utility pole 308, it connects by a 90 degree elbow 347 to another PVC segment 344. PVC segment 344 runs vertically upward and meets the utility pole 308 at its base.

Figure 23:
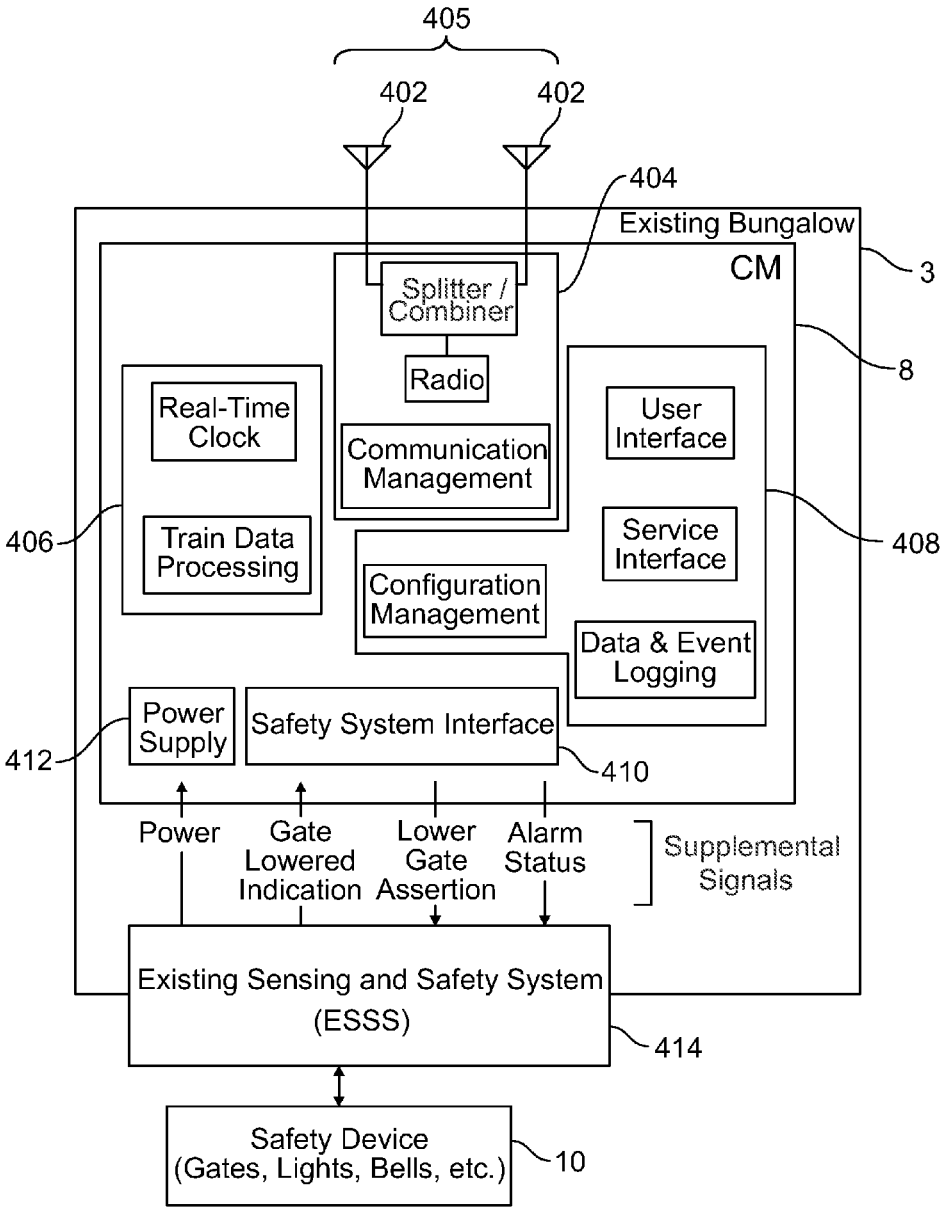
FIG. 23 shows a block diagram of a control module, according to the disclosure.

FIG. 23 shows the control module (CM) 8, the central control center for the rail line sensing and safety system 2. The main purpose of this module is to process signals transmitted from the remote module's and then control a safety device 10, either directly (see FIG. 24) or indirectly (see FIG. 23) as a backup or supplement to an existing sensing and safety system (ESSS). Typically, the rail line sensing and safety system 2 contains only one control module, but it may contain more than one, for example, one for each side of the safety device 10. Although the following discussion refers to a single control module, it should be understood that there could be more than one.

According to FIG. 23, the control module 8 is comprised of at least two radio transceiver antennas 402, typically one to receive signals from each remote module 6 located on opposite sides of the safety device 10. In general, signals transmitted and received from antennas travel directionally (as opposed to omni-directionally), and because typically at least one remote module 6 is located down the track on each side of the control module 8, the signals sent by the remote modules 6 are typically received by the control module 8 from opposite directions. Thus, the rail line sensing and safety system 2 typically utilizes two antennas so each can be pointed directly toward its associated remote module 6.

The control module 8 further comprises a wireless transceiver circuit 404, a signal and data processing circuit 406, a monitoring and control module 408, a safety system interface 410, and a power supply 412. The wireless transceiver circuit 404 further contains a splitter/combiner that combines (or selects) the signals from (or between) multiple radio transceiver antennas 402, a radio transceiver such as a base FHSS radio transceiver, a communication management circuit and optionally a cellular link and a GPS module. The wireless transceiver circuit 404 together with a radio transceiver antenna 402 constitutes a wireless transceiver 405 that communicates with the wireless transmitter 324 of a remote module 6, typically to receive signals sent from the remote module 6 to the control module 8 (see FIG. 1).

The signal and data processing circuit 406 further contains a real-time clock which may have a WWV receiver for automatic time synchronization, and a data processor circuit that processes signals from the remote modules regarding vehicles traveling on the rail. (Note: WWV is the call sign of the United States National Institute of Standards and Technology's shortwave radio station, and WWV continuously transmits official U.S. Government frequency and time signals.) The monitoring and control module 408 further contains a user interface, a service interface such as a microSD slot, USB port or Ethernet port, a configuration management module and a data and event logging module. The data and event logging module may log system information and diagnostic about remote modules as well as the control module itself. The power supply 412 may contain power handling circuitry including a temperature compensated circuit for transferring power from solar panels to a rechargeable battery.

The control module 8 receives vehicle detection events from the remote modules 6 which include time-stamped track identification, and information about the presence, speed, and direction of vehicles traveling on the rail. Detection events are generated by the detection modules and remote modules at the start and end of a vehicle traveling on the rail, and the remote modules 6 transmit these detection events as signals to the control module 8. Alternatively, the detection modules and remote modules may generate events and transmit signals for each discrete axle of the vehicle.

The control module data processor circuit 406 analyzes and validates incoming detection events and determines whether to generate a signal to a safety device (either directly or indirectly), such as a signal to lower a gate or activate an alarm (see FIG. 23). The control module data processor circuit 406 also may contain fault detection functionalities whereby it recognizes and logs anomalous combinations of events which may or may not indicate an error or other failure in the rail line sensing and safety system 2. For example, if the control module detects an outbound vehicle (at the detection module on one side of the safety device) with no associated inbound detection (at the detection module on the other side of the safety device), an error or a "fault" may exist in the system.

The rail line sensing and safety system 2 may also incorporate this fault detection functionality at the sensor level. In this example, the signals detected from one of the sensors inside a detection module package is compared to the signals detected from the other sensor inside the same detection module package. Circuitry located inside the detection module, the remote module, the control module or some combination of these, compares the signals from each of the sensors within a detection module package and recognizes and logs anomalous combinations of events. For example, if one of the sensors within a detection module package is indicating a nearby, large, fast-moving object and the other sensor in the same package is outputting no signal, an error or a "fault" may exist in detection module package or in the system.

In one embodiment of the disclosure, the control module 8 is mounted inside an existing control bungalow 9 (see FIGS. 1 and 23) located on either side of a safety device 10 (for example, crossing gates). One benefit of this type of mounting is that installation is easy because no additional housings need to be built to contain the control modules. Additionally, it may be possible for the existing power source inside the control bungalow 9 to feed power to the control module 8. The existing power source may, for example, come from the existing sensing and safety system.

Figure 24:
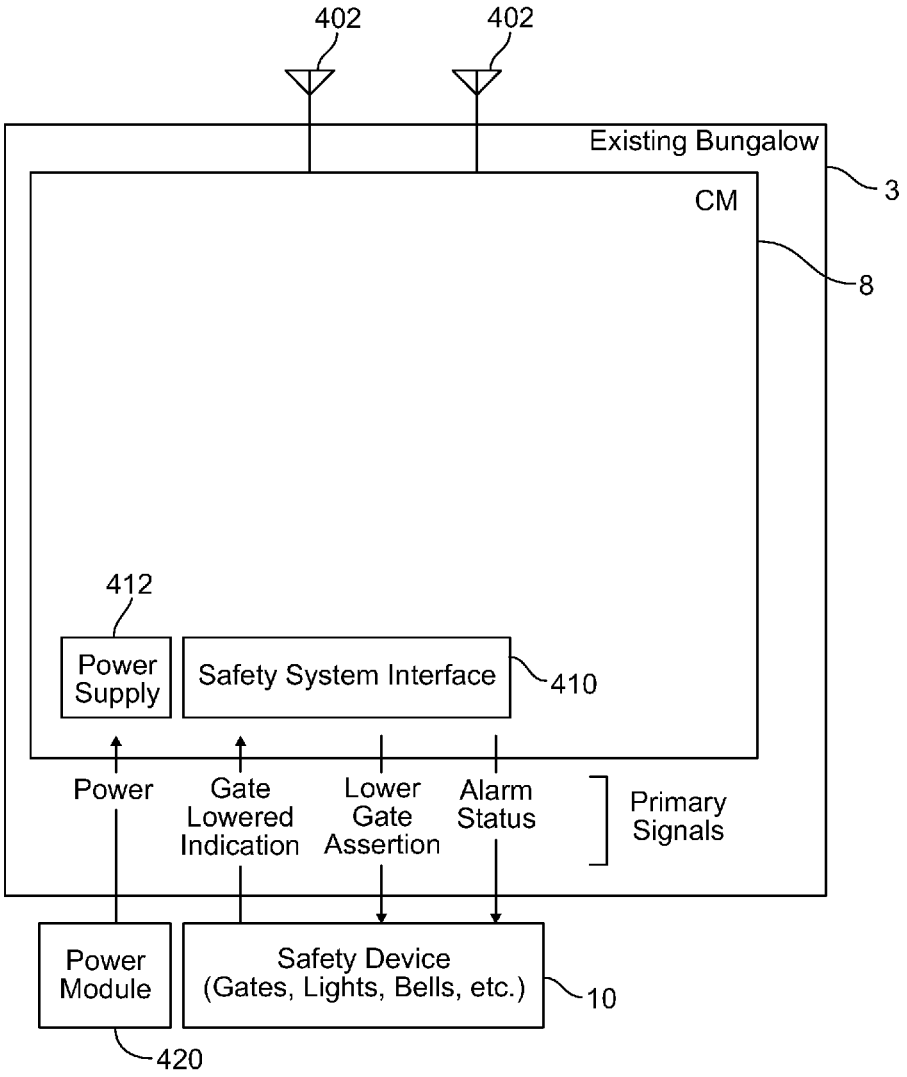
FIG. 24 shows a block diagram of a control module.

Referring to FIG. 24, if the control module 8 is unable to receive power from an existing power source, the control module may contain its own power module 420. Power module 420 may contain solar panels, battery packs or both. The solar panels may be mounted on a pole, similar to the setup of the utility pole 308 or the remote module 6. The same pole may also support the radio transceiver antennas 402.

The control module 8 and/or the remote module 6 may also utilize power saving features. For example, because the wireless transceiver (in the control module 8) and/or the wireless transmitter (in the remote module 6) may draw a large amount of current, the control module 8 and/or the remote module 6 may operate in a mode where the transceiver (in the control module 8) and/or the wireless transmitter (in the remote module 6) is normally powered down ("sleep mode") and where the transceiver and/or transmitter are "woken up" and synchronize each time a vehicle is detected. However, it should be noted that if the transceiver and/or transmitter synchronization takes too long after the transceiver and/or transmitter is "woken up", such that system integrity (i.e. there is concern that the synchronization will not complete before the vehicle reaches the safety device) becomes a concern, the control module 8 and/or the remote module 6 may operate in a mode where the wireless transceiver and/or wireless transmitter are operational ("awake") at all times.

Another example of a power saving feature that the control module 8 and/or the remote module 6 may utilize is a mode of operation where the control module 8 and/or the remote module 6 puts its main control processor to "sleep." Because the wireless transceiver (in the control module 8) and/or the wireless transmitter (in the remote module 6) have sufficient built-in intelligence to maintain a wireless link without requiring constant transmission and processing of substantive signals about vehicles, the main control processor in the control module 8 and/or the remote module 6 may sleep when there is inactivity in the system. The wireless link is maintained autonomously while the main processor is powered down. If the remote module 6 requires any substantive communication with the control module 8, such as a status update or a detection of a vehicle on the rail, it can wake up its own processor and/or signal to the control module 8, through the wireless radio link, to wake up its processor.

Referring to FIG. 23, in one embodiment, the rail line sensing and safety system 2 is installed as a backup or supplemental system to an existing sensing and safety system (ESSS) 414. In this embodiment, the control module 8 may interface with the card racks that are currently available inside the existing control bungalow 3. For example, the control module may plug into existing auxiliary inputs of the existing sensing and safety system. In operation, if the existing sensing and safety system either fails completely to detect an incoming train or is late in lowering the gates, the backup/supplemental system will provide an input signal to lower the gates, and then the existing sensing and safety system may activate and control the gates.

Referring to FIG. 24, in another embodiment, the rail line sensing and safety system 2 is installed as a primary control to a safety device 10 that may include gates, bells, lights, etc. In this embodiment, the control module 8 interfaces directly with the safety device 10, whereby the control module 8 interfaces with the safety device 10 such that the control module 8 instructs the safety device 10 to engage. For example, the control module 8 may directly instruct the safety system 10 to lower its gates.

As explained above, and considering FIG. 1, the rail line sensing and safety system 2 may have a single detection module 4 mounted a distance down the rail on each side of the safety device 10. Furthermore, as explained above, the rail line sensing and safety system 2 may have, one per side, a single radio link, including a transmitter located in the remote module 6 and transceiver located in the control module 8.

Figure 2:
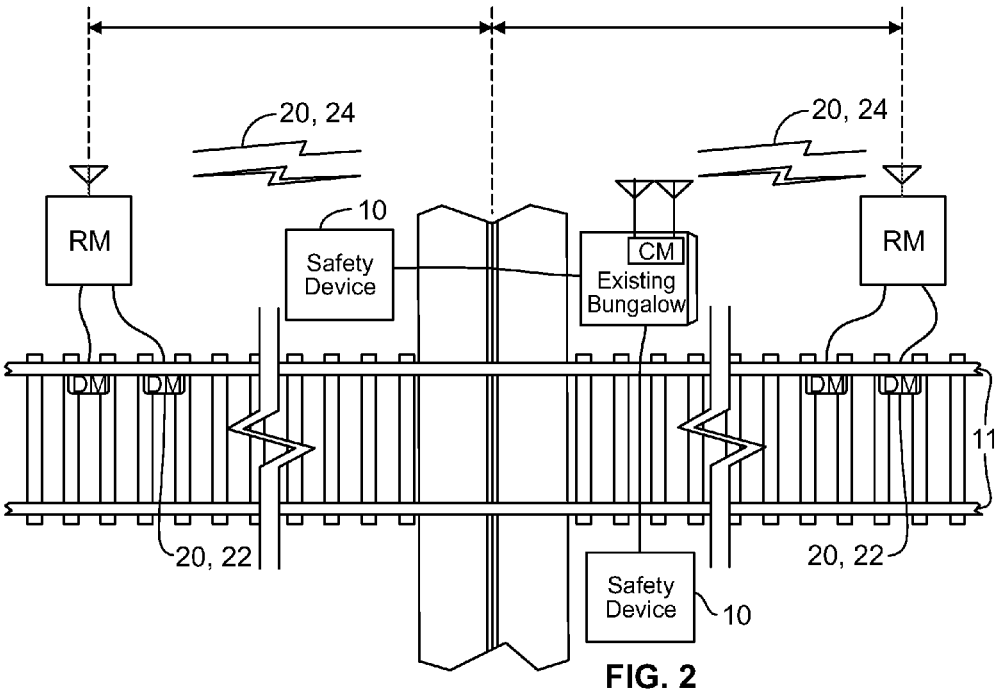
FIG. 2 shows a bird's eye schematic view of a rail line sensing and safety system.
Figure 3:
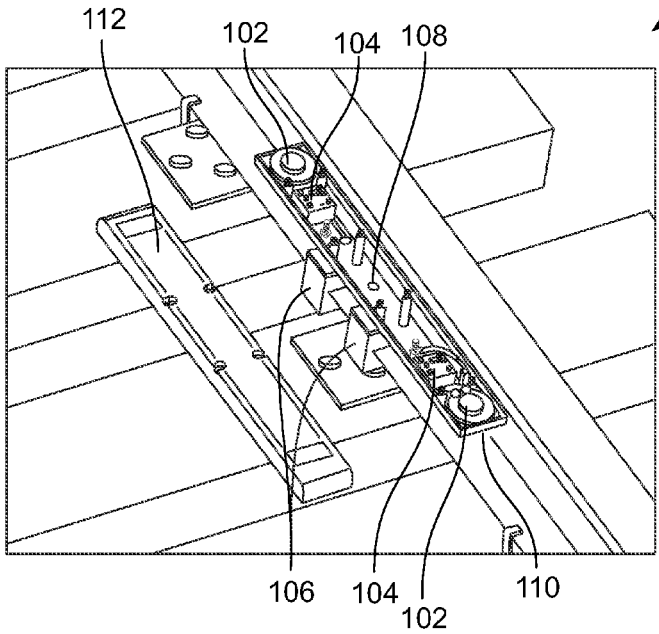
FIG. 3 shows an angled top view of a sensing device, also referred to as a detection module, according to the disclosure.

Alternatively, and considering FIG. 2, the rail line sensing and safety system 2 may be configured with added redundancy 20. The added redundancy 20 may consist of at least one additional detection module 22 mounted a distance down the rail 11 on each side of the safety device 10, such that each side has at least 2 detection modules 4, 22. Additionally, the added redundancy 20 may consist of at least one additional radio link 24 (transmitter and transceiver) on each side of the safety device 10. Each redundant radio link may operate on a different frequency than the initial radio link. Although the redundancy 20 is portrayed and explained as only one additional detection module per side and one additional radio link per side, it should be understood that the redundancy could be increased to include more than one detection module per side and more than one radio link per side. Additionally, the redundancy could include duplicates of other parts of the rail line sensing and safety system 2, to further enhance the reliable detection of light, fast-moving vehicles.

The redundancy 20 may be especially important if the rail line sensing and safety system 2 is installed as the primary control to a safety device 10, as shown in FIG. 24 and as explained above. In this embodiment, the rail line sensing and safety system 2 replaces an existing sensing and safety system completely or is installed instead of a more expensive system. Because no other sensing and safety system is installed, the redundancy 20, importantly, enhances the reliability of the detection modules and the radio links, such that the safety device 10 activates when a vehicle travels on the rail past the detection modules.

Although the redundancy 20 may be especially preferred when the rail line sensing and safety system 2 is installed as the primary control to a safety device 10, it may also be used in the embodiment (shown in FIG. 23 and explained above) where the rail line sensing and safety system 2 is installed as a backup or a supplement to an existing sensing and safety system. In this setup, the redundancy 20 acts as an additional layer of backup.

Regardless of whether the rail line sensing and safety system 2 is configured as a primary control to a safety device, or as a backup/supplement to an existing sensing and safety system, and regardless of whether the rail line sensing and safety system 2 is configured to included redundancies, the rail line sensing and safety system 2 provides several advantages over existing/current railroad sensing and safety systems.

It should be understood in regards to the following descriptions of an "existing system" or a "current system" that these current systems as described are examples of systems that the rail line sensing and safety system 2 of this disclosure may backup or supplement in the embodiment described herein where the rail line sensing and safety system 2 is configured to backup or supplement an existing sensing and safety system. Thus, the existing sensing and safety systems described in this disclosure may be similar to the current system described as follows, including the disadvantages of the current system.

The advantages of the rail line sensing and safety system 2 over the current system can be seen by looking at how the current system in use at many railroad crossing locations detects an approaching train. The current system sends an electrical signal down a rail, whereby the rail is used as a conductor for the signal to travel through. When a train approaches, the signal is shorted by a metallic wheel of the approaching train. This shorting requires that an electrical contact be made between the metallic rail and the metallic wheel. The change in the signal due to this shorting is then processed by the system to determine if a train is present, and if so, the system signals the crossing gates to lower.

There are several drawbacks to the current system that are not present if the rail line sensing and safety system is used. One drawback to the current system is that due to "interference" (for example, corrosion of the rail, weather or other environmental factors), the wheel of the train may not contact the rail with sufficient contact force to establish the required electrical connection between the wheel and the rail. In the best case scenario, this interference causes inconsistent readings in the system. In the worst case scenario, the system does not detect the approaching train and the crossing gate is never lowered. In the current system, attempts are sometimes made to improve consistency by adding additional axles (cars) to the train to add additional electrical contacts as well as additional weight and additional contact force. However, these extra cars often travel empty.

Another drawback to the current system is that the rated speed at which it can operate (i.e. at which trains can travel) is relatively low, currently limited to between 60 and 80 miles-per-hour. The current system requires this lower speed because, at a lower speed, the chances are higher of establishing the required electrical connection between the wheel and the rail.

The rail line sensing and safety system 2 does not suffer from the disadvantages of the current system. Interference with an electrical connection between the wheel and the rail is not an issue in the rail line sensing and safety system because the rail line sensing and safety system utilizes an advanced induction proximity sensor. This proximity sensor does not rely on the rail as a conductor and operates reliably even if the rail is contaminated. Therefore, by using the rail line sensing and safety system, the vehicles traveling on the rail need not carry additional empty cars nor limit their speed.

What is claimed is:

1. A sensing device for a rail line comprising:

a first sensor detecting a vehicle traveling on the rail line, the first sensor comprising a first coil of wire to inductively couple to a part of the vehicle, the first sensor operable to signal a first detection event;

a second sensor detecting the vehicle traveling on the rail line, the second sensor located a fixed distance away from the first sensor, the second sensor comprising a second coil of wire to inductively couple to a part of the vehicle, the second sensor operable to signal a second detection event;

electrical circuitry accepting signals from the first and second sensors, the electrical circuitry configured to generate:

for the first sensor, a first coupling signal and a first output pulse signal, and for the second sensor, a second coupling signal and a second output pulse signal; and electrical connections electrically connecting the first sensor, the second sensor, and the electrical circuitry;

wherein the first coupling signal has a magnitude based on the amount of inductive coupling between the first coil of wire and the vehicle, wherein the first output pulse signal is triggered when the amount of inductive coupling between the first coil of wire and the vehicle is at or exceeds a first predetermined level, wherein the second coupling signal has a magnitude based on the amount of inductive coupling between the second coil of wire and the vehicle, and wherein the second output pulse signal is triggered when the amount of inductive coupling between the second coil of wire and the vehicle is at or exceeds a second predetermined level.

2. The sensing device of claim 1 wherein the first sensor and the second sensor are inductive sensors, each sensor comprising wire wound on a ferrite core, and wherein the wire is Litz Wire, and wherein each sensor is capable of generating a magnetic field that extends a distance above the sensor, and wherein the electrical circuitry is capable of detecting an interruption in the magnetic field of either the first sensor, the second sensor, or both.

3. The sensing device of claim 2 wherein the ferrite core is a PQ-style ferrite core.

4. The sensing device of claim 1, wherein the first and second predetermined levels are approximately at a maximum.

5. The sensing device of claim 1, wherein, for each of the first sensor and the second sensor, as the vehicle gets closer to the sensor's coil of wire, the amount of inductive coupling between the coil of wire and the vehicle increases and the Q factor of the coil of wire decreases, and wherein the magnitude of the coupling signal increases when the amount of inductive coupling between the coil of wire and the vehicle increases.

6. The sensing device of claim 1, wherein the first output pulse signal generated by the circuitry for the first sensor corresponds to the signaling of the first detection event, and the second output pulse signal generated by the circuitry for the second sensor corresponds to the signaling of the second detection event.

7. The sensing device of claim 1, wherein the electrical circuitry comprises, for each of the first sensor and the second sensor, a peak-and-hold detector that is operable to:

detect a peak in the magnitude of the coupling signal, and trigger the output pulse signal when the peak in the magnitude of the coupling signal is detected.

8. The sensing device of claim 7, wherein the electrical circuitry comprises, for each of the first sensor and the second sensor, a capacitor located between the wire carrying the coupling signal and the peak-and-hold detector, and wherein the capacitor removes a DC component of the coupling signal, allowing only an AC component of the coupling signal to pass through to the peak-and-hold detector, and wherein the capacitor ensures that static DC-signal drift in the coupling signal is not introduced to the peak-and-hold detector.

9. The sensing device of claim 1, wherein the electrical circuitry comprises, for each of the first sensor and the second sensor, an amplifier operable to amplify the coupling signal, the amplifier comprising a feedback path having a Zener diode to produce a logarithmic transfer characteristic of the amplifier such that the amplifier is capable of accurately handling the coupling signal regardless of whether its magnitude is large or small.

10. The sensing device of claim 1, wherein the electrical circuitry comprises, for each of the first sensor and the second sensor, a comparator operable to terminate the output pulse when the magnitude of the coupling signal falls from a peak magnitude to below a threshold value.

11. The sensing device of claim 1, wherein the electrical circuitry for each of the first sensor and the second sensor is operable to detect an error or a fault in the electrical circuitry and to generate an error signal when the error or fault is detected.

12. The sensing device of claim 1, further comprising a sensor package that houses at least the two sensors, the electrical circuitry and the electrical connections, wherein the sensor package includes an upper casing and a lower casing such that when the two casings are affixed together, a cavity is defined between them, wherein the sensor package includes an attachment device for attaching the sensor package to the rail line.

13. The sensing device of claim 12 wherein the attachment device is an energy absorbing mounting system comprised of:

a clamp assembly for attaching the sensor package to the rail line;

aluminum shims and vibration absorption pads disposed between the sensor package and the clamp assembly, wherein the vibration absorption pads are composed of rubber or an elastomeric material or other vibration absorbing material;

cap screws that run vertically through the sensor package, the aluminum shims, the vibration absorption pads, and into the clamp assembly, wherein the cap screws apply clamping force to attach the sensor package to the rest of the attachment device and to hold the parts of the attachment device together; and lock pins that are inserted horizontally into the side of the sensor package to prevent the cap screws from rotating.

14. The sensing device of claim 1, wherein the electrical circuitry includes a signal processor.

15. The sensing device of claim 14 wherein the signal processor is programmed to calculate the direction, speed or both of the vehicle traveling on the rail line by detecting the order of the first detection event in relation to the second detection event, and measuring the time period between the detection events.

16. The sensing device of claim 1, further comprising:

at least one additional sensor capable of detecting the vehicle traveling on the rail line and signaling at least one additional detection event, wherein the electrical circuitry also accepts signals from the at least one additional sensor, wherein the electrical connections also electrically connect the at least one additional sensor.

17. A rail line sensing and safety system comprising:

at least one sensing device comprising:

a first sensor capable of detecting a vehicle traveling on the rail line and signaling a first detection event;

a second sensor capable of detecting the vehicle traveling on the rail line and signaling a second detection event, wherein the second sensor is located a fixed distance away from the first sensor;

electrical circuitry that accepts signals from the two sensors; and electrical connections that electrically connect the two sensors and the electrical circuitry, wherein each sensing device outputs one or more signals that indicate at least one of the presence, direction and speed of a vehicle traveling on the rail line;

at least one remote module that accepts signals outputted by at least one of the sensing devices, wherein the remote module processes signals and transmits one or more signals, wherein the remote module is located near the sensing device from which it accepts signals;

a control module that accepts signals outputted by at least one of the remote modules, wherein the control module performs operations based on signals and outputs one or more signals;

one or more solar panels electrically connected to at least one of the sensing device, the remote module, and the control module; and one or more battery packs electrically connected to at least one of the sensing device, the remote module and the control module wherein the signals outputted by the control module indicate whether one or more safety devices should be activated, the safety devices being lights, gates, bells, visual, audio or physical warnings, and combinations thereof, wherein the control module and the safety devices are located near an intersection of a rail line and a road, a second rail line, or other path of travel.

18. The rail line sensing and safety system of claim 17 wherein the signals outputted by the control module are sent directly to the one or more safety devices, and wherein the rail line sensing and safety system provides primary control signals for the safety devices.

19. The rail line sensing and safety system of claim 18 further comprising at least one backup sensing device, wherein at least one sensing device located on either side of the safety devices is backed up, as a form of redundancy, by the at least one backup sensing device, wherein the backup sensing device is located a distance away from the sensing device that it backs up, wherein the backup sensing device outputs signals that indicate at least one of the presence, direction and speed of a vehicle traveling on the rail line.

20. The rail line sensing and safety system of claim 17 wherein the sensing and safety system is adapted to be a supplemental or backup system to a separate existing system, and wherein the signals outputted by the control module are sent to the existing system, and wherein the existing system controls one or more safety devices.

21. The rail line sensing and safety system of claim 20 wherein the existing system attempts to detect the vehicle traveling on the rail line by sending one or more electrical signals down one or more rails of the rail line, whereby the rail operates as a conductor for the one or more signals to travel through.

22. The rail line sensing and safety system of claim 20 further comprising at least one backup sensing device, wherein at least one sensing device located on either side of the safety devices is backed up, as a form of redundancy, by the at least one backup sensing device, wherein the backup sensing device is located a distance away from the sensing device that it backs up, wherein the backup sensing device outputs signals that indicate at least one of the presence, direction and speed of a vehicle traveling on the rail line.

23. The rail line sensing and safety system of claim 17 further comprising at least one sensor that monitors health of at least one device or module in the system, including the sensing device and the remote module, wherein the signals transmitted by the remote module and sent to the control module periodically include information regarding health of at least one device or module, wherein the control module is adapted to accept signals and information regarding health of devices or modules.

24. The rail line sensing and safety system of claim 17 wherein the control module includes computing equipment capable of data logging and self-diagnostics.

25. The rail line sensing and safety system of claim 17 further comprising a display that is part of the control module, wherein the display conveys system diagnostics and status indicators.

26. The rail line sensing and safety system of claim 17 wherein the remote module transmits one or more signals using a frequency hopping radio.

27. The rail line sensing and safety system of claim 17 wherein the remote module transmits one or more signals using a cellular network.

28. The rail line sensing and safety system of claim 17 wherein the remote module transmits one or more signals using a licensed frequency.

29. The rail line sensing and safety system of claim 17 wherein the sensing device is located a distance away from the one or more safety devices that the sensing and safety system controls, wherein the distance is between 3,800 feet and 4,500 feet.

* * * * *